US011376474B2

(12) United States Patent
Engle et al.

(10) Patent No.: US 11,376,474 B2
(45) **Date of Patent: *Jul. 5, 2022**

(54) GOLF BALL

(71) Applicant: Acushnet Company, Fairhaven, MA (US)

(72) Inventors: Courtney N. Engle, Fall River, MA (US); Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/151,946

(22) Filed: Jan. 19, 2021

(65) Prior Publication Data

US 2021/0138305 A1 May 13, 2021

Related U.S. Application Data

(63) Continuation-in-part of application No. 16/927,457, filed on Jul. 13, 2020, now Pat. No. 10,894,189, which is a continuation-in-part of application No. 16/673,782, filed on Nov. 4, 2019, now Pat. No. 10,709,936, which is a continuation-in-part of application No. 16/214,316, filed on Dec. 10, 2018, now Pat. No. 10,463,918, which is a continuation-in-part of application No. 15/707,043, filed on Sep. 18, 2017, now Pat. No. 10,150,005, which is a continuation-in-part of application No. 15/220,703, filed on Jul. 27, 2016, now Pat. No. 9,764,193, which is a continuation-in-part of application No. 15/162,717, filed on May 24, 2016, now Pat. No. 10,258,832, which is a continuation of (Continued)

(51) Int. Cl.
*A63B 37/06* (2006.01)
*A63B 37/00* (2006.01)

(52) U.S. Cl.
CPC ..... *A63B 37/0006* (2013.01); *A63B 37/0012* (2013.01)

(58) Field of Classification Search
CPC ..... A63B 37/0006; A63B 37/0012
USPC ..... 473/378, 382, 383
See application file for complete search history.

(56) References Cited

U.S. PATENT DOCUMENTS 5,005,838 A 4/1991 Oka
5,156,404 A 10/1992 Oka et al.

(Continued)

*Primary Examiner* — Raeann Gorden

(57) ABSTRACT

Golf balls including at least one modified dimple group are disclosed. The modified dimple group comprises one or more modified dimples forming an axially symmetric pattern about a Correction Area Centroid located on an axis of symmetry at a latitude greater than 0°, where 0° represents the hemispherical pole and 90° represents the equator. The modified dimples can be altered, for example, by changing dimple coverage, dimple diameter, dimple depth, dimple edge angle, dimple volume, dimple cross-sectional shape, and/or dimple plan shape. Optionally, the dimples have a catenary cross-sectional shape and the modified dimples are altered by changing the shape factor and/or chord depth. Such modifications preferably produce a golf ball that flies more consistently regardless of orientation when struck than a corresponding golf ball without such modifications.

21 Claims, 28 Drawing Sheets

Related U.S. Application Data application No. 14/159,495, filed on Jan. 21, 2014, now Pat. No. 9,782,628, which is a continuation-in-part of application No. 12/895,105, filed on Sep. 30, 2010, now Pat. No. 8,632,425.

(56) References Cited

U.S. PATENT DOCUMENTS

| | | | | |
|---|---|---|---|---|
| 5,308,076 | A | 5/1994 | Sun | |
| 5,569,100 | A | 10/1996 | Molitor et al. | |
| 5,908,359 | A | 6/1999 | Shimosaka et al. | |
| 5,980,232 | A | 11/1999 | Shimosaka et al. | |
| 6,066,055 | A | 5/2000 | Nishino | |
| 6,176,793 | B1 | 1/2001 | Sullivan et al. | |
| 6,346,054 | B1 | 2/2002 | Shimosaka et al. | |
| 6,475,106 | B1 | 11/2002 | Green et al. | |
| 7,163,472 | B2 | 1/2007 | Dalton et al. | |
| 7,621,827 | B2 | 11/2009 | Sajima | |
| 10,183,196 | B2 | 1/2019 | Sato | |
| 10,463,918 | B2 * | 11/2019 | Madson | A63B 37/002 |
| 10,709,936 | B2 * | 7/2020 | Madson | A63B 37/0006 |
| 2008/0125250 | A1 | 5/2008 | Lee | |
| 2010/0240473 | A1 | 9/2010 | Aoyama et al. | |

* cited by examiner

A
A
A

GOLF BALL

CROSS-REFERENCE TO RELATED APPLICATIONS

The present application is a continuation-in-part of U.S. patent application Ser. No. 16/927,457, filed Jul. 13, 2020, which is a continuation-in-part of U.S. patent application Ser. No. 16/673,782, filed Nov. 4, 2019, now U.S. Pat. No. 10,709,936, which is a continuation-in-part of U.S. patent application Ser. No. 16/214,316, filed Dec. 10, 2018, now U.S. Pat. No. 10,463,918, which is a continuation-in-part of U.S. patent application Ser. No. 15/707,043, filed Sep. 18, 2017, now U.S. Pat. No. 10,150,005, which is a continuation-in-part of U.S. patent application Ser. No. 15/220,703, filed Jul. 27, 2016, now U.S. Pat. No. 9,764,193, which is a continuation-in-part of U.S. patent application Ser. No. 15/162,717, filed May 24, 2016, now U.S. Pat. No. 10,258,832, which is continuation of U.S. patent application Ser. No. 14/159,495, filed Jan. 21, 2014, now U.S. Pat. No. 9,782,628, which is a continuation-in-part of U.S. patent application Ser. No. 12/895,105, filed Sep. 30, 2010, now U.S. Pat. No. 8,632,425, the entire disclosures of which are hereby incorporated herein by reference.

FIELD OF THE INVENTION

The present invention relates to golf balls, and more particularly, to golf balls having modified dimples that improve symmetric performance.

BACKGROUND OF THE INVENTION

Golf balls generally include a spherical outer surface with a plurality of dimples formed thereon. The dimples on a golf ball improve the aerodynamic characteristics of a golf ball and, therefore, golf ball manufacturers have researched dimple patterns, shape, volume, and cross-section in order to improve the aerodynamic performance of a golf ball. Determining specific dimple arrangements and dimple shapes that result in an aerodynamic advantage requires an understanding of how a golf ball travels through air.

When a golf ball travels through the air, the air surrounding the ball has different velocities and, thus, different pressures. The air develops a thin boundary layer adjacent to the ball's outer surface. The air exerts maximum pressure at a stagnation point on the front of the ball. The air then flows over the sides of the ball and has increased velocity and reduced pressure. The air separates from the surface of the ball at a top and a bottom separation point, leaving a large turbulent flow area called the wake that has low pressure. The difference in the high pressure in front of the ball and the low pressure behind the ball slows the ball down. This is the primary source of drag, which is the air resistance that acts on the golf ball in the direction opposite the ball's flight direction.

The dimples on a golf ball cause the thin boundary layer to flow in a turbulent manner. Rather than flowing in smooth, continuous layers (i.e., a laminar boundary layer), this turbulent boundary layer has a microscopic pattern of fluctuations and randomized flow. It is the circumference of each dimple, where the dimple wall drops away from the outer surface of the ball, which actually creates the turbulence in the boundary layer. The turbulence energizes the boundary layer and helps move the separation points further backward, so that the layer stays attached further along the ball's outer surface. As a result, there is a reduction in the area of the wake, increasing the average pressure behind the ball, and a substantial reduction in drag.

The shape of each dimple is also important in optimizing lift, which is an upward force on the ball that is created by a difference in pressure between the top of the ball and the bottom of the ball. This difference in pressure is created by a warp in the air flow that results from the ball's backspin. Due to the backspin, the top of the ball moves in the direction of the airflow, which shifts the top separation point to a location further backward. Conversely, the bottom of the ball moves against the air flow, which moves the bottom separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball.

By using dimples to decrease drag and increase lift, almost every golf ball manufacturer has increased their golf ball flight distances. However, a golf ball must meet certain standards in order to be included on the official Conforming Golf Balls List (the "List") produced by the United States Golf Association and The Royal and Ancient Golf Club of St. Andrews, Scotland, the two ruling bodies for the game of golf. Inclusion on the List is important for the commercial success of a golf ball, because it is a requirement for use in competitive golf, and because, even for recreational golf, most serious players won't use a ball unless it appears on the List.

One of the standards, commonly referred to as the "Symmetry Rule," specifies that a ball must fly essentially the same distance and for essentially the same amount of time regardless of how it is oriented when struck by the golf club. It is important for a ball to have this property not only for inclusion on the List, but also to ensure consistent performance in use. If a ball flies farther when oriented in a certain way, it would cause the golfer to hit the ball farther than intended if the ball happened to be oriented that way before being struck. Commercial golf balls may fly differently in particular orientations, mostly due to asymmetry in the dimple pattern resulting from the inclusion of a straight dimple-free path around the equator of the ball. This path, or "parting line" or "great circle" was necessary to provide a place for the two halves of the mold to separate during the molding process. The effect was worsened by abrasive buffing that was performed on the parting line to remove flash and other molding artifacts. It was discovered that the effect could be minimized or eliminated by altering a group of dimples centered at the pole of each hemisphere, usually by making them shallower.

Seamless balls have been developed which use a corrugated or staggered parting line that weaves around the dimples to disguise its presence and minimize the disruption to the dimple pattern. Although it was believed that this type of parting line would improve symmetry of flight, it was found that seamless balls do not always display satisfactory symmetrical flight performance.

Using modified dimples in polar regions of seamless golf balls has been proposed as a means of improving symmetry, as disclosed, for example, in U.S. Patent Application Publication No. 2010/0240473, the entire disclosure of which is hereby incorporated herein by reference.

SUMMARY OF THE INVENTION

In one embodiment, the present invention is directed to a golf ball comprising dimples on the outermost surface thereof. The dimples have a catenary cross-sectional shape and consist of a majority of unmodified dimples and a plurality of modified dimples. The modified dimples are arranged in two or more groups, each group forming an axially symmetric pattern about a different geometric center. Each modified dimple has a shape factor that is from 10% to 60% different than that of the unmodified dimples and/or a chord depth that is from 0.0002 inches to 0.0010 inches different than that of the unmodified dimples.

In another embodiment, the present invention is directed to a golf ball comprising a plurality of dimples on the outermost surface thereof. The golf ball consists of two hemispheres. Each hemisphere consists of two first regions and two second regions. The two first regions have an identical first dimple pattern. The two second regions have an identical second dimple pattern. Each of the first dimple pattern and the second dimple pattern comprises a plurality of unmodified dimples having a circular plan shape and at least one modified dimple having a non-circular plan shape.

In another embodiment, the present invention is directed to a golf ball having dimples on the outermost surface thereof, wherein the dimples consist of a majority of unmodified dimples having the same edge angle, and a plurality of modified dimples having an edge angle that is from 1° to 4° different than the edge angle of the unmodified dimples. The modified dimples are arranged in a plurality of modified dimple groups, each group forming an axially symmetric pattern about a different geometric center located on a non-polar axis of the ball. The axially symmetric patterns formed by the modified dimple groups include at least two different patterns. The golf ball consists of four quarter-spheres, each quarter-sphere comprising at least two modified dimple groups.

In another embodiment, the present invention is directed to a golf ball having dimples on the outermost surface thereof, wherein the dimples consist of a majority of unmodified dimples having the same edge angle, and a plurality of modified dimples having an edge angle that is from 1° to 4° different than the edge angle of the unmodified dimples. The modified dimples are arranged in two or more groups, each group forming an axially symmetric pattern about a different geometric center located on a non-polar axis of the ball. The difference in diameter between any two modified dimples within a single modified dimple group is 0.020 inches or less.

In another embodiment, the present invention is directed to a golf ball having dimples on the outermost surface thereof, wherein the dimples consist of a majority of unmodified dimples having the same edge angle, and a plurality of modified dimples having an edge angle that is from 1° to 4° different than the edge angle of the unmodified dimples. The modified dimples are arranged in a plurality of modified dimple groups, each group consisting of modified dimples forming an axially symmetric pattern about a different geometric center located on a non-polar axis of the ball. The golf ball consists of two hemispheres having identical dimple patterns, each hemisphere comprising at least three modified dimple groups. Each of the plurality of modified dimple groups consists of modified dimples having at least two different diameters.

In another embodiment, the present invention is directed to a golf ball having dimples on the outermost surface thereof, wherein the dimples consist of a majority of unmodified dimples having the same edge angle, and a plurality of modified dimples having an edge angle that is from 1° to 4° different than the edge angle of the unmodified dimples. The modified dimples are arranged in a plurality of modified dimple groups, each group consisting of modified dimples forming an axially symmetric pattern about a different geometric center located on a non-polar axis of the ball. The golf ball consists of two hemispheres having identical dimple patterns, each hemisphere consisting three modified dimple groups. The axially symmetric pattern formed by each of the modified dimple groups includes a modified dimple having a center that is coincident with the geometric center of the pattern.

In another embodiment, the present invention is directed to a golf ball comprising a plurality of dimples forming an overall dimple pattern on the outermost surface thereof. The golf ball consists of two hemispheres having identical dimple patterns, each hemisphere consisting of two first regions and two second regions. The two first regions have an identical first dimple pattern and the two second regions have an identical second dimple pattern, the first dimple pattern being different from the second dimple pattern. Each of the first dimple pattern and the second dimple pattern consists of a majority of unmodified dimples having the same edge angle and a plurality of modified dimples having an edge angle that is from 1° to 4° different than the edge angle of the unmodified dimples. The plurality of modified dimples of the first dimple pattern form a first axially symmetric pattern about a first geometric center, the plurality of modified dimples of the second dimple pattern form a second axially symmetric pattern about a second geometric center, the first axially symmetric pattern being different from the second axially symmetric pattern. In a particular aspect of this embodiment, a first reference circle circumscribing the plurality of modified dimples of the first dimple pattern has a diameter of greater than 0.875 inches and a second reference circle circumscribing the plurality of modified dimples of the second dimple pattern has a diameter of greater than 0.875 inches. In another particular aspect of this embodiment, a first reference circle circumscribing the plurality of modified dimples of the first dimple pattern has a diameter of greater than 0.850 inches and a second reference circle circumscribing the plurality of modified dimples of the second dimple pattern has a diameter of greater than 0.850 inches; optionally, the modified dimples of the first dimple pattern have substantially the same diameter and/or the modified dimples of the second dimple pattern have substantially the same diameter.

In another embodiment, the present invention is directed to a golf ball comprising a plurality of dimples forming an overall dimple pattern on the outermost surface thereof. The golf ball consists of two hemispheres having identical dimple patterns, each hemisphere consisting of two first regions and two second regions. The two first regions have an identical first dimple pattern and the two second regions have an identical second dimple pattern, the first dimple pattern being different from the second dimple pattern. Each of the first dimple pattern and the second dimple pattern consists of a majority of unmodified dimples having the same edge angle and a plurality of modified dimples having an edge angle that is from 1° to 4° different than the edge angle of the unmodified dimples. The plurality of modified dimples of the first dimple pattern form a first axially symmetric pattern about a first geometric center, and the plurality of modified dimples of the second dimple pattern form a second axially symmetric pattern about a second geometric center. Optionally, the first axially symmetric pattern is different from the second axially symmetric pattern. Each modified dimple of the first dimple pattern is nearest neighbors with another modified dimple of the first dimple pattern. Each modified dimple of the second dimple pattern is nearest neighbors with another modified dimple of the second dimple pattern.

In another embodiment, the present invention is directed to a golf ball comprising a plurality of dimples forming an overall dimple pattern on the outermost surface thereof. The golf ball consists of two hemispheres having identical dimple patterns, each hemisphere consisting of two first regions and two second regions. The two first regions have an identical first dimple pattern and the two second regions have an identical second dimple pattern, the first dimple pattern being different from the second dimple pattern. Each of the first dimple pattern and the second dimple pattern consists of a majority of unmodified dimples having the same edge angle and a plurality of modified dimples having an edge angle that is from 1° to 4° different than the edge angle of the unmodified dimples. The plurality of modified dimples of the first dimple pattern form a first axially symmetric pattern about a first geometric center, and the plurality of modified dimples of the second dimple pattern form a second axially symmetric pattern about a second geometric center. Each modified dimple of the first dimple pattern is nearest neighbors with another modified dimple of the first dimple pattern, and at least one modified dimple of the first dimple pattern is nearest neighbors with two or more modified dimples of the first dimple pattern. Each modified dimple of the second dimple pattern is nearest neighbors with another modified dimple of the second dimple pattern.

In another embodiment, the present invention is directed to a golf ball comprising a plurality of dimples forming an overall dimple pattern on the outermost surface thereof. The golf ball consists of two hemispheres having identical dimple patterns, each hemisphere consisting of two first regions and two second regions. The two first regions have an identical first dimple pattern and the two second regions have an identical second dimple pattern, the first dimple pattern being different from the second dimple pattern. Each of the first dimple pattern and the second dimple pattern consists of a majority of unmodified dimples and a plurality of modified dimples. The plurality of modified dimples of the first dimple pattern form a first axially symmetric pattern about a first geometric center, the plurality of modified dimples of the second dimple pattern form a second axially symmetric pattern about a second geometric center. A first reference circle circumscribing the plurality of modified dimples of the first dimple pattern has a diameter of greater than 0.850 inches, and a second reference circle circumscribing the plurality of modified dimples of the second dimple pattern has a diameter of greater than 0.850 inches. Optionally, the modified dimples within the first dimple pattern have substantially the same diameter and/or the modified dimples within the second dimple pattern have substantially the same diameter. Optionally, the number of modified dimples of the first dimple pattern is equal to the number of modified dimples of the second dimple pattern. In a particular aspect of this embodiment, the dimples are spherical dimples and the unmodified and modified dimples are distinguishable based on edge angle. Thus, in this particular aspect, the majority of the dimples are unmodified dimples having the same edge angle, and each of the modified dimples has an edge angle that is from 1° to 4° different than the edge angle of the unmodified dimples. In another particular aspect of this embodiment, the dimples are catenary dimples and the unmodified and modified dimples are distinguishable based on shape factor. Thus, in this particular aspect, the majority of the dimples are unmodified dimples having the same shape factor, and each of the modified dimples has a shape factor that is at least 10% greater than or less than the shape factor of the unmodified dimples. In another particular aspect of this embodiment, the dimples are catenary dimples and the unmodified and modified dimples are distinguishable based on chord depth. Thus, in this particular aspect, the majority of the dimples are unmodified dimples having the same chord depth, and each of the modified dimples has a chord depth that is at least 0.0002 inches greater than or less than the chord depth of the unmodified dimples.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION

Figure 1:
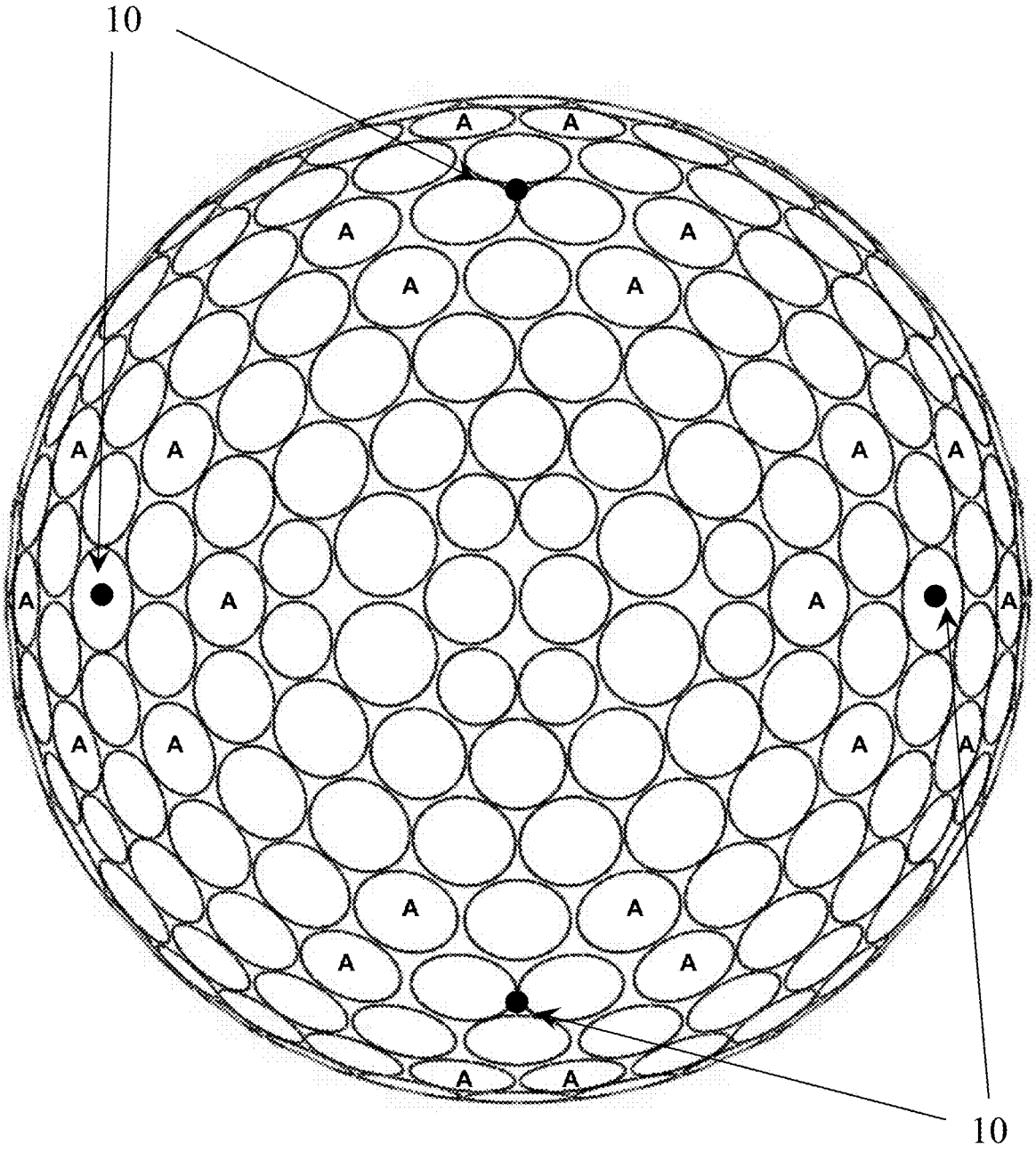
FIG. 1 is a polar view of a golf ball having an arrangement of modified dimples according to an embodiment of the present invention.

While the present invention is not meant to be limited by any particular pattern of the overall dimple arrangement, golf balls of the present invention preferably have an overall dimple pattern formed by generating one or more domains from a polyhedron, and tessellating the domain(s) over the ball, as disclosed, for example, in U.S. Patent Application Publication No. 2010/0113187, the entire disclosure of which is hereby incorporated herein by reference. By arranging dimples in this manner, the symmetry of the underlying polyhedron is preserved and great circles due to parting lines are eliminated. The resulting overall dimple pattern has multiple axes of symmetry, typically including a polar symmetry axis and multiple non-polar symmetry axes. For purposes of the present disclosure, the symmetry axes are lines about which the overall dimple pattern can be rotated through some angle smaller than 360° which brings the pattern to a new orientation which appears identical to its starting position. The symmetry axes of an overall dimple pattern on a golf ball necessarily intersect at a common point at the center of the ball.

Golf balls of the present invention include, on each hemisphere of the ball, at least one modified dimple group having a geometric center, also referred to herein as a Correction Area Centroid ("CAC"), located on one of the multiple axes of symmetry in the overall dimple pattern, preferably a non-polar axis of symmetry. In one embodiment, golf balls of the present invention include at least one modified dimple group on each quarter-sphere of the ball. In another embodiment, golf balls of the present invention include at least two modified dimple groups on each quarter-sphere of the ball. In another embodiment, each hemisphere of the ball comprises at least three modified dimple groups, each of the modified dimple groups having a geometric center located on one of the multiple axes of symmetry in the overall dimple pattern, preferably non-polar axes of symmetry. In another embodiment, each hemisphere of the ball consists of three modified dimple groups, each of the modified dimple groups having a geometric center located on one of the multiple axes of symmetry in the overall dimple pattern.

The CAC of each group may fall within an unmodified dimple, a modified dimple, or on the land area of the golf ball surface.

Preferably, the modified dimple groups are located such that the CAC of each group is located at a latitude angle ("$\varphi_{CAC}$") of greater than 0°, or greater than 5°, or greater than 15°, or greater than 30°, or 45° or greater, or greater than 45°, or 50° or greater, or at a $\varphi_{CAC}$ within a range having a lower limit of 5° or 15° or 30° or 35° or 40° or 45° and an upper limit of 55° or 60° or 65° or 75° or 80° or 90°, where 0° represents the hemispherical pole and 90° represents the equator.

Modified dimple groups of the present invention include groups of one or more modified dimples. For purposes of the present invention, the term "modified" means altered from the typical configuration based on the overall pattern of dimples on the ball, and the term "dimple" includes any texturizing on the surface of a golf ball, e.g., depressions and projections, which may have a variety of planform shapes, including, but not limited to, circular, polygonal, oval, or irregular shapes, and a variety of cross-sectional shapes, including, but not limited to, circular, catenary, elliptical, or conical shapes.

The approximate total number of dimples to be modified and the location of the modified dimple groups on the outermost surface of the ball are determined based on the flight performance of the ball prior to modifying dimples and the desired flight performance of the final product. Preferably, the same modifications are performed on both hemispheres of the ball, i.e., the ball consists of identical hemispheres. In a particular embodiment, the same modifications are performed on all four quarter-spheres of the ball. In another particular embodiment, each hemisphere can be divided into three identical regions, with the same modifications performed on each region.

The pattern of each modified dimple group can vary substantially, and the present invention is not meant to be limited by any particular pattern. Preferably, each modified dimple group has a pattern that is axially symmetric, i.e., symmetric about the axis of symmetry containing the group's CAC. In embodiments of the present invention wherein each hemisphere includes two or more modified dimple groups, the pattern formed by one group can be the same as or different than the pattern formed by another group within the hemisphere, and the dimple count among modified dimple groups having different patterns may be the same or different. Similarly, in embodiments of the present invention wherein each quarter-sphere includes two or more modified dimple groups, the pattern formed by one group can be the same as or different than the pattern formed by another group within the quarter-sphere, and the dimple count among modified dimple groups having different patterns may be the same or different. Thus, in one embodiment, each quarter-sphere of the ball comprises at least two modified dimple groups, including at least two different patterns within each quarter-sphere. In a particular aspect of this embodiment, the modified dimple groups have one or more of the following properties:

(a) at least one pattern is present in all of the quarter-spheres;

(b) at least two patterns are present in all of the quarter-spheres; and (c) at least two patterns are present in all of the quarter-spheres, including at least two patterns having different dimple counts.

In a particular aspect of embodiments of the present invention wherein the dimple count among modified dimple groups is different, the difference in dimple count between any two modified dimple groups is four dimples or less, or three dimples or less, or two dimples or less, or the difference is one dimple.

In one embodiment, each modified dimple group is circumscribed by a circle having a diameter of no greater than 0.875 inches, or no greater than 0.800 inches, or no greater than 0.750 inches, or no greater than 0.600 inches. In another embodiment, one or more modified dimple groups is circumscribed by a circle having a diameter of greater than 0.850 inches, or greater than 0.875 inches, or 0.900 inches or greater, or 1.000 inches or greater, or 1.100 inches or greater. In another embodiment, one modified dimple group is circumscribed by a circle having a diameter of 0.900 inches or greater, and another modified dimple group is circumscribed by a circle having a diameter of 1.100 inches or greater. In another embodiment, each modified dimple group is circumscribed by a circle having a diameter of greater than 0.850 inches, and the dimples optionally have one or more of the following additional properties:

(a) a majority of the dimples on the ball (i.e., the unmodified dimples) are circular plan-shaped dimples having the same edge angle, i.e., their respective edge angles differ by no more than 0.2°; each modified dimple is a circular plan-shaped dimple having an edge angle that is from 1° to 4°, or from 1° to 3°, different than the edge angle of the majority of the dimples; optionally, all of the modified dimples have the same edge angle; and, optionally, all of the dimples on the outer surface of the ball are spherical dimples;

(b) a majority of the dimples on the ball (i.e., the unmodified dimples) are catenary dimples having the same shape factor; each modified dimple is a catenary dimple having a shape factor that is at least 10%, or from 10% to 60%, different than the shape factor of the unmodified dimples; and, optionally, all of the modified dimples have the same shape factor;

(c) a majority of the dimples on the ball (i.e., the unmodified dimples) are catenary dimples having the same chord depth; each modified dimple is a catenary dimple having a chord depth that is at least 0.0002 inches, or from 0.0002 inches to 0.0010 inches, different than the chord depth of the unmodified dimples; and, optionally, all of the modified dimples have the same chord depth;

(d) at least one of the modified dimple groups consists of same diameter dimples;

(e) each modified dimple group consists of same diameter dimples, but the diameter of the modified dimples of one modified dimple group is different from the diameter of the modified dimples of another modified dimple group;

(f) all of the modified dimples on the golf ball have substantially the same diameter;

(g) each modified dimple group consists of the same number of modified dimples;

(h) the number of modified dimples within one modified dimple group is different than the number of modified dimples within another modified dimple group;

(i) for at least one modified dimple group, none of the modified dimples of the modified dimple group is nearest neighbors with a modified dimple of another modified dimple group;

(j) for every modified dimple group, none of the modified dimples of one modified dimple group is nearest neighbors with a modified dimple of another modified dimple group;

(k) the CAC of at least one modified dimple group is positioned on the land area of the golf ball surface;

(l) the CAC of every modified dimple group is positioned on the land area of the golf ball surface;

(m) at least one modified dimple group is inscribed by a reference circle having a diameter of 0.750 inches or greater, or a diameter of 0.850 or greater, or a diameter of 0.950 or greater;

(n) each modified dimple has a dimple diameter that is not the minimum or maximum dimple diameter on the ball;

(o) the dimple diameter of at least one modified dimple is the maximum dimple diameter on the ball;

(p) the dimple diameter of at least one modified dimple is the minimum dimple diameter on the ball;

(q) for at least one modified dimple group, each modified dimple within the modified dimple group is nearest neighbors with another modified dimple in the same modified dimple group;

(r) for at least one modified dimple group, no modified dimple within the modified dimple group is nearest neighbors with another modified dimple in the same modified dimple group; and (s) each modified dimple group includes at least six modified dimples.

For purposes of the present invention, the "circle circumscribing a modified dimple group" (or "reference circle circumscribing a plurality of modified dimples") refers to the circle having the smallest diameter that is drawn around all of the modified dimples in the group without cutting any of the modified dimples and has a point of tangency with at least one of the modified dimples. Similarly, for purposes of the present invention, the "reference circle inscribing a plurality of modified dimples" refers to the circle having the largest diameter that is drawn within all of the modified dimples in the group without cutting any of the modified dimples and has a point of tangency with at least one of the modified dimples. It should be understood that these circumscribing and inscribing circles are reference circles relating to the positioning of the modified dimples, and do not appear on the final golf ball. In embodiments of the present invention where a modified dimple group consists of a single dimple, the diameter of the circle circumscribing the modified dimple group is equal to the diameter of the modified dimple.

In a particular embodiment, among modified dimple groups having different patterns, the difference between the diameter of the circle circumscribing one modified dimple group and the diameter of the circle circumscribing another modified dimple group having a different pattern, excluding modified dimple groups consisting of one dimple, is 0.200 inches or less. In a particular aspect of this embodiment, the circles circumscribing the modified dimples groups have substantially the same diameter such that the ratio of the diameters is from 0.90 to 1.10. In another particular embodiment, among modified dimple groups having different patterns, the difference between the diameter of the circle circumscribing one modified dimple group and the diameter of the circle circumscribing all other modified dimple groups having a different pattern, excluding modified dimple groups consisting of one dimple, is 0.200 inches or less. In a particular aspect of this embodiment, all of the circles circumscribing the modified dimples groups on the ball, excluding modified dimple groups consisting of one dimple, have substantially the same diameter such that the ratio of the diameters is from 0.90 to 1.10.

In another particular embodiment, among modified dimple groups having different patterns, the ratio of the surface area of the fret of one modified dimple group to the surface area of the fret of another modified dimple group having a different pattern, excluding modified dimple groups consisting of one dimple, is 0.80 or 0.90 or 1.10 or 1.25 or is within a range having a lower limit and an upper limit selected from these values. In another particular embodiment, among modified dimple groups having different patterns, the ratio of the surface area of the fret of one modified dimple group to the surface area of the fret of all other modified dimple groups having a different pattern, excluding modified dimple groups consisting of one dimple, is 0.80 or 0.90 or 1.10 or 1.25 or is within a range having a lower limit and an upper limit selected from these values. For purposes of the present invention, the "surface area of the fret of a modified dimple group" refers to the surface area of the golf ball not covered by dimples within the circle circumscribing the modified dimple group.

In another particular embodiment, the ratio of the average surface volume of the dimples in one modified dimple group to the average surface volume of the dimples in another modified dimple group is 0.60 or 0.80 or 1.25 or 1.67 or is within a range having a lower limit and an upper limit selected from these values. In another particular embodiment, the ratio of the average surface volume of the dimples in one modified dimple group to the average surface volume of the dimples in all other modified dimple groups is 0.60 or 0.80 or 1.25 or 1.67 or is within a range having a lower limit and an upper limit selected from these values.

Figure 12A:
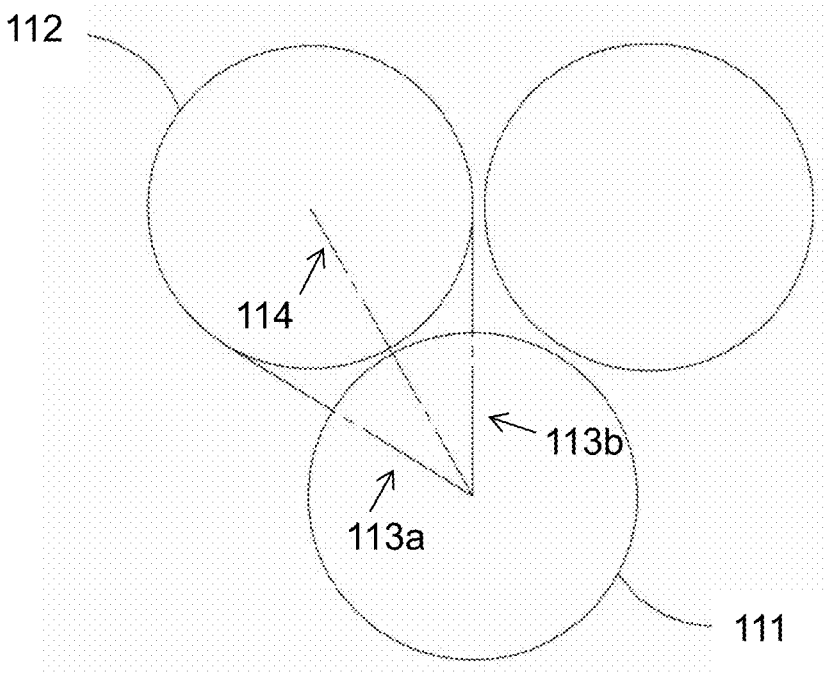
FIGS. 12A and 12B illustrate a method for determining nearest neighbor dimples.
Figure 12B:
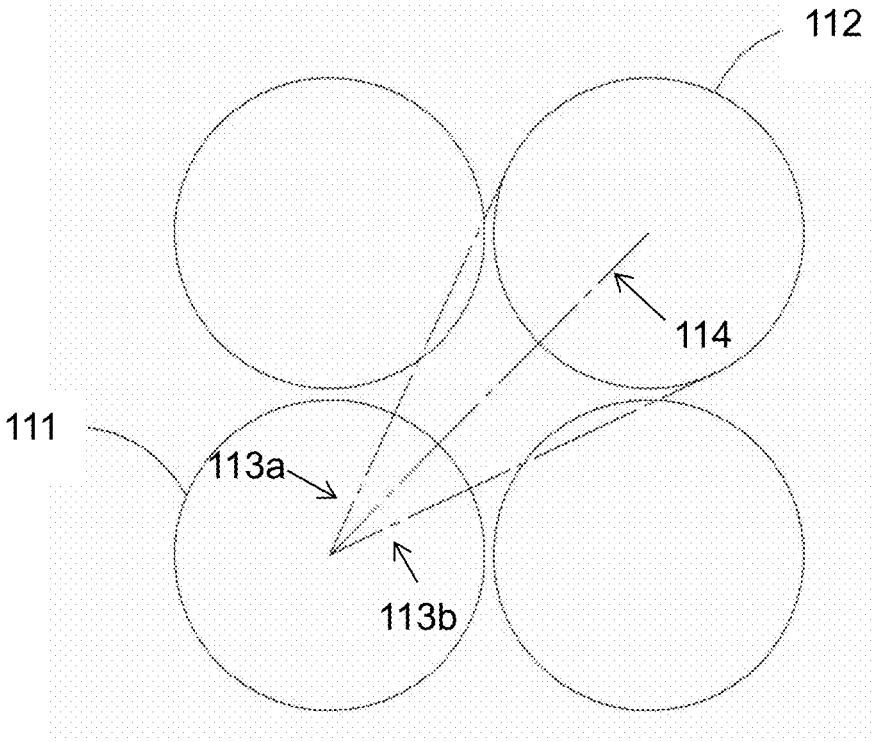

In another embodiment, each modified dimple is nearest neighbors with at least one other modified dimple of the same modified dimple group. In a particular aspect of this embodiment, at least one modified dimple of one modified dimple group is nearest neighbors with two or more modified dimples of the same modified dimple group. For purposes of the present disclosure, nearest neighbor dimples are determined according to the following method. A reference dimple and a potential nearest neighbor dimple are selected such that the reference dimple has substantially the same diameter or a smaller diameter than the potential nearest neighbor dimple. Two tangency lines are drawn from the center of the reference dimple to the potential nearest neighbor dimple. A line segment is then drawn connecting the center of the reference dimple to the center of the potential nearest neighbor dimple. If the two tangency lines and the line segment do not intersect any other dimple edges, then those dimples are considered to be nearest neighbors. For example, as shown in FIG. 12A, two tangency lines 113A and 113B are drawn from the center of a reference dimple 111 to a potential nearest neighbor dimple 112. Line segment 114 is then drawn connecting the center of reference dimple 111 to the center of potential nearest neighbor dimple 112. Tangency lines 113A and 113B and line segment 114 do not intersect any other dimple edges, so dimple 111 and dimple 112 are considered nearest neighbors. In FIG. 12B, two tangency lines 113A and 113B are drawn from the center of a reference dimple 111 to a potential nearest neighbor dimple 112. Line segment 114 is then drawn connecting the center of reference dimple 111 to the center of potential nearest neighbor dimple 112. Tangency lines 113A and 113B intersect an alternative dimple, so dimple 111 and dimple 112 are not considered nearest neighbors. Those skilled in the art will recognize that the line segments do not actually have to be drawn on the golf ball. Rather, a computer modeling program capable of performing this operation automatically is preferably used.

While the degree of dimple modification depends on the ball's overall dimple pattern and the total number of dimples, the total number of modified dimples is preferably ¼ of the total number of dimples or less.

The modified dimples can be altered in any suitable manner, including, but not limited to, modifying diameter, depth, volume, edge angle, edge radius, cross-sectional shape, perimeter shape, and any combination of two or more thereof.

In a particular embodiment, the majority of the unmodified dimples have a catenary cross-sectional shape and each of the modified dimples has a catenary cross-sectional shape, wherein each of the modified dimples has a shape factor and/or a chord depth that is different than the shape factor and/or chord depth of the catenary-shaped unmodified dimples. In a particular aspect of this embodiment, each modified dimple has a shape factor that is at least 10%, or at least 20%, different than that of the unmodified dimples, or a shape factor that is from 10% or 20% or 25% to 45% or 50% or 60% different than that of the unmodified dimples. Each modified dimple can have the same shape factor or a different shape factor than the other modified dimples. The shape factor is an independent variable in the mathematical function that defines a catenary dimple cross-sectional shape, as further disclosed in, for example, U.S. Pat. No. 6,796,912 to Dalton et al., U.S. Pat. No. 7,163,472 to Dalton et al., U.S. Pat. No. 7,491,137 to Bissonnette et al., and U.S. Pat. No. 7,887,439 to Aoyama et al., the entire disclosures of which are hereby incorporated herein by reference. In another particular aspect of this embodiment, each modified dimple has a chord depth that is at least 0.0001 inches, or at least 0.0002 inches, different than that of the unmodified dimples, or a chord depth that is from 0.0001 inches or 0.0002 inches to 0.0005 inches or 0.0010 inches different than that of the unmodified dimples. Each modified dimple can have the same chord depth or a different chord depth than the other modified dimples.

In another particular embodiment, a majority of the dimples (i.e., the unmodified dimples) have the same edge angle and a plurality of the dimples (i.e., the modified dimples) have an edge angle that is from 1° to 4°, or from 1° to 3°, different than the edge angle of the majority of the dimples. For purposes of the present invention, dimples have the "same edge angle" if their respective edge angles differ by no more than 0.2°. In a particular aspect of this embodiment, the dimples have one or more of the following properties:

(a) the difference in diameter between any two modified dimples within a single modified dimple group is 0.020 inches or less;

(b) the difference in diameter between any two modified dimples on the golf ball is 0.050 inches or less;

(c) at least one of the modified dimple groups consists of modified dimples having substantially the same diameter, i.e., their respective diameters differ by less than 0.005 inches;

(d) all of the dimples in a first modified dimple group have substantially the same diameter, all of the dimples in a second modified dimple group in the same quarter-sphere as the first modified dimple group have substantially the same diameter, but the diameter of the dimples in the first modified dimple group is different from the diameter of the dimples in the second modified dimple group;

(e) all of the modified dimples on the golf ball have substantially the same diameter;

(f) each of the unmodified dimples has a circular plan shape;

(g) each of the modified dimples has a circular plan shape; and (h) each modified dimple is nearest neighbors with another modified dimple in the same modified dimple group.

In another particular aspect of this embodiment, the dimples have one or more of the following properties:

(a) each modified dimple group consists of modified dimples having at least two different diameters;

(b) the axially symmetric pattern formed by each of the modified dimple groups is identical;

(c) each modified dimple group includes at least three modified dimples, or at least four modified dimples, or at least five modified dimples, or at least six modified dimples, or at least seven modified dimples;

(d) the difference in diameter between any two modified dimples on the golf ball is 0.100 inches or less;

(e) the average dimple diameter of all modified dimples on the golf ball is 0.165 inches or greater;

(f) the average dimple diameter of all modified dimples on the golf ball is 0.160 inches or less;

(g) the geometric center of each modified dimple group is located at a latitude angle of greater than 45°, where 0° represents the hemispherical pole and 90° represents the equator;

(h) each of the majority of unmodified dimples has a circular plan shape;

(i) each of the plurality of modified dimples has a circular plan shape;

(j) each modified dimple group can be circumscribed by a circle having a diameter of 0.800 inches or less, or 0.600 inches or less;

(k) the geometric center of each modified dimple group is coincident with the center of a modified dimple;

(l) the geometric center of each modified dimple group is coincident with the center of an unmodified dimple;

(m) the dimple pattern on each hemisphere on the ball is identical, each hemisphere can be divided into three regions having identical dimple patterns, and each region includes at least one modified dimple group; and (n) each modified dimple is nearest neighbors with another modified dimple in the same modified dimple group.

In another particular aspect of this embodiment, the dimples have one or more of the following properties:

(a) at least one modified dimple group is circumscribed by a reference circle having a diameter of greater than 0.875 inches, or a diameter of 0.900 inches or greater, or a diameter of 1.000 inches or greater, or a diameter of 1.100 inches or greater;

(b) each modified dimple group is circumscribed by a reference circle having a diameter of greater than 0.875 inches;

(c) one modified dimple group is circumscribed by a reference circle having a diameter of 0.900 inches or greater and another modified dimple group is circumscribed by a reference circle having a diameter of 1.100 inches or greater;

(d) the difference in diameter between any two reference circles circumscribing two modified dimple groups, excluding modified dimple groups consisting of one dimple, is 0.250 inches or less;

(e) at least one modified dimple group is inscribed by a reference circle having a diameter of 0.500 inches or greater, or a diameter of 0.650 inches or greater, or a diameter of 0.800 inches or greater;

(f) each modified dimple group is inscribed by a reference circle having a diameter of 0.500 inches or greater;

(g) the difference between the average dimple diameter of the modified dimples of one modified dimple group and the average dimple diameter of the modified dimples of any other modified dimple group is 0.020 inches or less;

(h) at least one modified dimple group includes dimples having at least two different diameters;

(i) each modified dimple group includes dimples having at least two different diameters;

(j) for at least one modified dimple group, the difference between the dimple diameters of any two modified dimples is 0.020 inches or less;

(k) for each modified dimple group, the difference between the dimple diameters of any two modified dimples within the group is 0.020 inches or less;

(l) the difference in diameter between any two modified dimples on the golf ball is 0.050 inches or less;

(m) each modified dimple group includes at least three modified dimples, or at least four modified dimples, or at least five modified dimples, or at least six modified dimples, or at least seven modified dimples;

(n) all of the modified dimple groups have the same number of modified dimples;

(o) the number of modified dimples of one modified dimple group is different from the number of modified dimples of at least one other modified dimple group;

(p) each of the modified dimple groups has a modified group area ($A_{GROUP}$) of 0.500 $in^2$ or 0.600 $in^2$ or 0.950 $in^2$ or 1.000 $in^2$ or a modified group area ($A_{GROUP}$) within a range having a lower limit and an upper limit selected from these values; and (q) each modified dimple is nearest neighbors with another modified dimple in the same modified dimple group.

For purposes of the present disclosure, the modified group area ($A_{GROUP}$) of a modified dimple group is defined by the following equation:

$$A_{GROUP}=A_C-A_I$$

where $A_C$ is the area of a reference circle circumscribing the modified dimple group and $A_I$ is the area of a reference circle inscribing the modified dimple group.

In another particular embodiment, the overall dimple pattern includes at least three different dimple diameters, including a minimum dimple diameter, a maximum dimple diameter, and at least one additional dimple diameter, and consists of a majority of unmodified dimples having the same edge angle and a plurality of modified dimples having an edge angle that is from 1° to 4°, or from 1° to 3°, different than the edge angle of the unmodified dimples. In a particular aspect of this embodiment, the dimples optionally have one or more of the following additional properties:

(a) the dimple pattern on each of the two hemispheres of the ball is identical;

(b) the dimple pattern on each hemisphere consists of two first regions having an identical first dimple pattern and two second regions having an identical second dimple pattern, the first dimple pattern being different from the second dimple pattern;

(c) each of the first and second dimple patterns consists of a majority of unmodified dimples and a plurality of modified dimples;

(d) the plurality of modified dimples of the first dimple pattern form a first axially symmetric pattern about a first geometric center, and the plurality of modified dimples of the second dimple pattern form a second axially symmetric pattern about a second geometric center;

(e) each modified dimple of the first dimple pattern is nearest neighbors with another modified dimple of the first dimple pattern;

(f) each modified dimple of the second dimple pattern is nearest neighbors with another modified dimple of the second dimple pattern;

(g) the modified dimples of the first dimple pattern include at least one modified dimple having the minimum dimple diameter and at least one modified dimple having the maximum dimple diameter, and:

(i) optionally, each modified dimple of the first dimple pattern having the minimum dimple diameter is nearest neighbors with a modified dimple having the maximum dimple diameter and is not nearest neighbors with a modified dimple having the minimum dimple diameter; and (ii) optionally, each modified dimple of the first dimple pattern having the maximum dimple diameter is nearest neighbors with a modified dimple having the minimum dimple diameter and is not nearest neighbors with a modified dimple having the maximum dimple diameter;

(h) the maximum dimple diameter is at least 0.050 inches greater than the minimum dimple diameter;

(i) the modified dimples of the second dimple pattern have substantially the same diameter;

(j) a first reference circle circumscribing the plurality of modified dimples of the first dimple pattern has a diameter of greater than 0.875 inches, or 1.000 inches or greater, and a second reference circle circumscribing the plurality of modified dimples of the second dimple pattern has a diameter of greater than 0.875 inches, or 0.900 inches or greater, and, optionally, the difference in the diameter of the first reference circle and the diameter of the second reference circle is 0.250 inches or less;

(k) a third reference circle inscribing the modified dimples of the first dimple pattern has a diameter of 0.500 inches or greater, or 0.550 inches or greater, and a fourth reference circle inscribing the modified dimples of the second dimple pattern has a diameter of 0.500 inches or greater, or 0.650 inches or greater;

(l) the modified dimples of the first dimple pattern have a modified group area ($A_{GROUP}$) of 0.500 $in^2$ or 1.000 $in^2$ or have a modified group area ($A_{GROUP}$) within a range having a lower limit and an upper limit selected from these values;

(m) the modified dimples of the second dimple pattern have a modified group area ($A_{GROUP}$) of 0.200 $in^2$ or 0.500 $in^2$ or have a modified group area ($A_{GROUP}$) within a range having a lower limit and an upper limit selected from these values;

(n) the number of modified dimples of the first dimple pattern is the same as the number of modified dimples of the second dimple pattern; and (o) the number of modified dimples of the first dimple pattern is different from the number of modified dimples of the second dimple pattern.

In another particular aspect of this embodiment, the dimples optionally have one or more of the following additional properties:

(a) the dimple pattern on each of the two hemispheres of the ball is identical;

(b) the dimple pattern on each hemisphere consists of two first regions having an identical first dimple pattern and two second regions having an identical second dimple pattern, the first dimple pattern being different from the second dimple pattern;

(c) each of the first and second dimple patterns consists of a majority of unmodified dimples and a plurality of modified dimples;

(d) the plurality of modified dimples of the first dimple pattern form a first axially symmetric pattern about a first geometric center, and the plurality of modified dimples of the second dimple pattern form a second axially symmetric pattern about a second geometric center;

(e) each modified dimple of the first dimple pattern is nearest neighbors with another modified dimple of the first dimple pattern;

(f) each modified dimple of the second dimple pattern is nearest neighbors with another modified dimple of the second dimple pattern;

(g) the modified dimples of the first dimple pattern do not include any dimples having the minimum dimple diameter;

(h) the modified dimples of the first dimple pattern do not include any dimples having the maximum dimple diameter;

(i) the modified dimples of the second dimple pattern have substantially the same diameter;

(j) the maximum dimple diameter is at least 0.050 inches greater than the minimum dimple diameter;

(k) a first reference circle circumscribing the plurality of modified dimples of the first dimple pattern has a diameter of greater than 0.875 inches, or 1.000 inches or greater, and a second reference circle circumscribing the plurality of modified dimples of the second dimple pattern has a diameter of greater than 0.875 inches, or 0.900 inches or greater, and, optionally, the difference in the diameter of the first reference circle and the diameter of the second reference circle is 0.250 inches or less;

(l) a third reference circle inscribing the modified dimples of the first dimple pattern has a diameter of 0.500 inches or greater, or 0.550 inches or greater, and a fourth reference circle inscribing the modified dimples of the second dimple pattern has a diameter of 0.500 inches or greater, or 0.650 inches or greater;

(m) the modified dimples of the first dimple pattern have a modified group area ($A_{GROUP}$) of 0.500 $in^2$ or 1.000

$in^2$ or have a modified group area ($A_{GROUP}$) within a range having a lower limit and an upper limit selected from these values;

(n) the modified dimples of the second dimple pattern have a modified group area ($A_{GROUP}$) of 0.200 $in^2$ or 0.500 $in^2$ or have a modified group area ($A_{GROUP}$) within a range having a lower limit and an upper limit selected from these values;

(o) the number of modified dimples of the first dimple pattern is the same as the number of modified dimples of the second dimple pattern; and (p) the number of modified dimples of the first dimple pattern is different from the number of modified dimples of the second dimple pattern.

In another particular aspect of this embodiment, the dimples optionally have one or more of the following additional properties:

(a) the dimple pattern on each of the two hemispheres of the ball is identical;

(b) the dimple pattern on each hemisphere consists of two first regions having an identical first dimple pattern and two second regions having an identical second dimple pattern, the first dimple pattern being different from the second dimple pattern;

(c) each of the first and second dimple patterns consists of a majority of unmodified dimples and a plurality of modified dimples;

(d) the plurality of modified dimples of the first dimple pattern form a first axially symmetric pattern about a first geometric center, and the plurality of modified dimples of the second dimple pattern form a second axially symmetric pattern about a second geometric center;

(e) each modified dimple of the first dimple pattern is nearest neighbors with another modified dimple of the first dimple pattern;

(f) at least one modified dimple of the first dimple pattern is nearest neighbors with two or more modified dimples of the first dimple pattern;

(g) each modified dimple of the second dimple pattern is nearest neighbors with another modified dimple of the second dimple pattern;

(h) the modified dimples of the first dimple pattern include at least one modified dimple having the maximum dimple diameter, and, optionally, each modified dimple of the first dimple pattern that has the maximum dimple diameter is nearest neighbors with only one modified dimple;

(i) the modified dimples of the second dimple pattern have substantially the same diameter;

(j) a first reference circle circumscribing the plurality of modified dimples of the first dimple pattern has a diameter of 0.750 inches or less, or a diameter of less than 0.750 inches;

(k) a second reference circle circumscribing the plurality of modified dimples of the second dimple pattern has a diameter of 0.750 inches or less, or a diameter of less than 0.750 inches;

(l) a third reference circle inscribing the modified dimples of the first dimple pattern has a diameter of 0.400 inches or less, or a diameter of less than 0.400 inches, or a diameter of 0.075 inches or less, or a diameter of less than 0.075 inches;

(m) a fourth reference circle inscribing the modified dimples of the second dimple pattern has a diameter of 0.400 inches or less, or a diameter of less than 0.400 inches;

(n) the modified dimples of the first dimple pattern have a modified group area ($A_{GROUP}$) of from 0.200 $in^2$ to 0.500 $in^2$;

(o) the modified dimples of the second dimple pattern have a modified group area ($A_{GROUP}$) of 0.200 $in^2$ or 0.500 $in^2$; and (p) the number of modified dimples of the first dimple pattern is the same as the number of modified dimples of the second dimple pattern.

In another particular embodiment, one or more dimple groups are modified in such a way as to make them less aggressive aerodynamically, such as by reducing dimple diameter, depth, volume, and/or edge angle. In another particular embodiment, one or more dimple groups are modified in such a way as to make them more aerodynamically aggressive, such as by increasing edge angle, volume, and/or by adding sub-dimples, i.e., dimples within a dimple. Sub-dimples are further disclosed, for example, in U.S. Pat. No. 6,569,038, the entire disclosure of which is hereby incorporated herein by reference.

The modified dimples can retain essentially the same appearance as or can be visually different from the unmodified dimples. Alterations that typically, but do not necessarily, result in modified dimples that retain essentially the same appearance as the unmodified dimples include, but are not limited to, changes to the dimple edge angle, depth, and volume, moderate changes to the cross-sectional profile, and moderate changes to the shape factor of catenary dimples. Alterations that typically, but do not necessarily, result in modified dimples that are visually different from the unmodified dimples include, but are not limited to, changes to the dimple diameter, plan shape and size, substantial changes to the cross-sectional profile, and substantial changes to the shape factor of catenary dimples. Dimples of the present invention having a modified depth preferably have a depth that is not greater than 90%, more preferably not greater than 80%, of the thickness of the outermost layer of the golf ball. Some dimples may be removed from the pattern by reducing their volume by about 100% to about zero. In this embodiment, by virtue of the types or magnitudes of the changes, the modified dimples are visually different from the unmodified dimples.

In embodiments of the present invention wherein each hemisphere includes two or more modified dimple groups, the dimples of one group may be altered in the same manner as or a different manner than another. Similarly, one dimple may be altered in the same or a different way than another dimple in the same dimple group.

Figure 2:
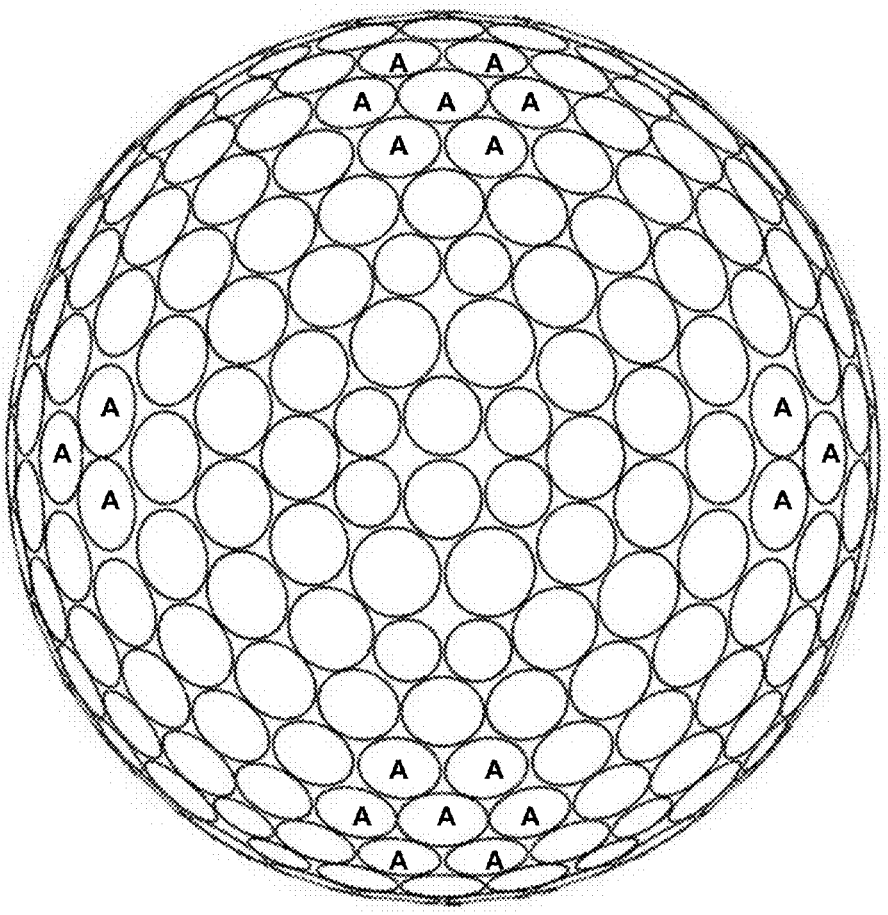
FIG. 2 is a polar view of a golf ball having an arrangement of modified dimples according to another embodiment of the present invention.
Figure 3:
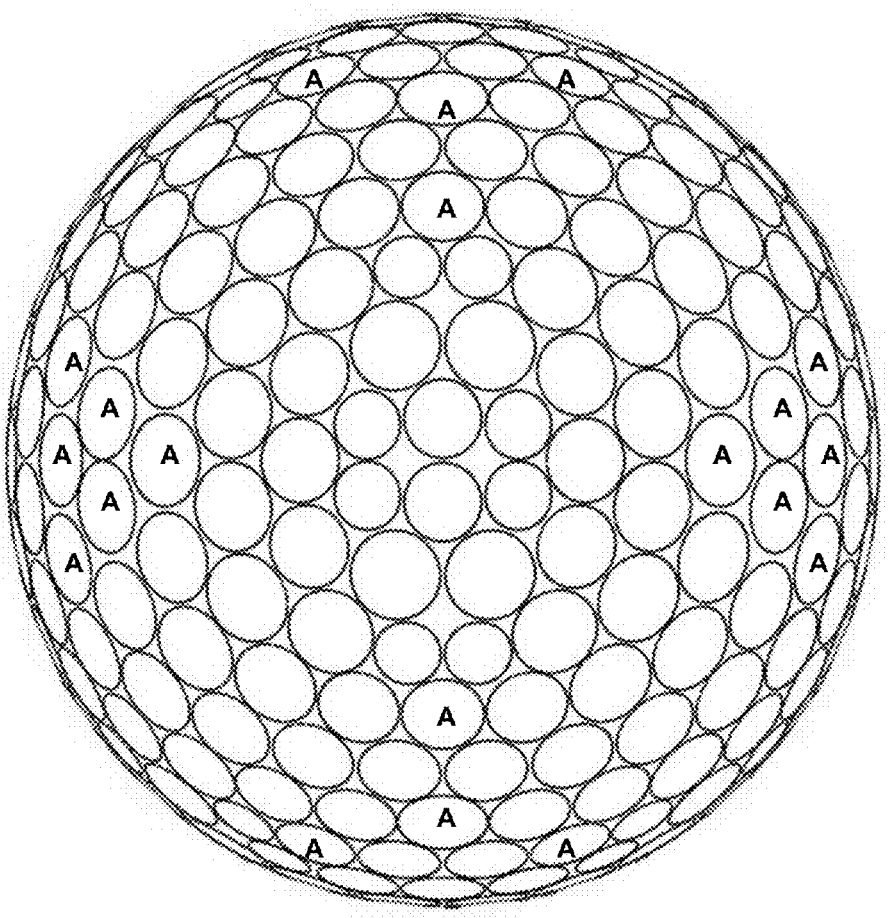
FIG. 3 is a polar view of a golf ball having an arrangement of modified dimples according to another embodiment of the present invention.
Figure 4:
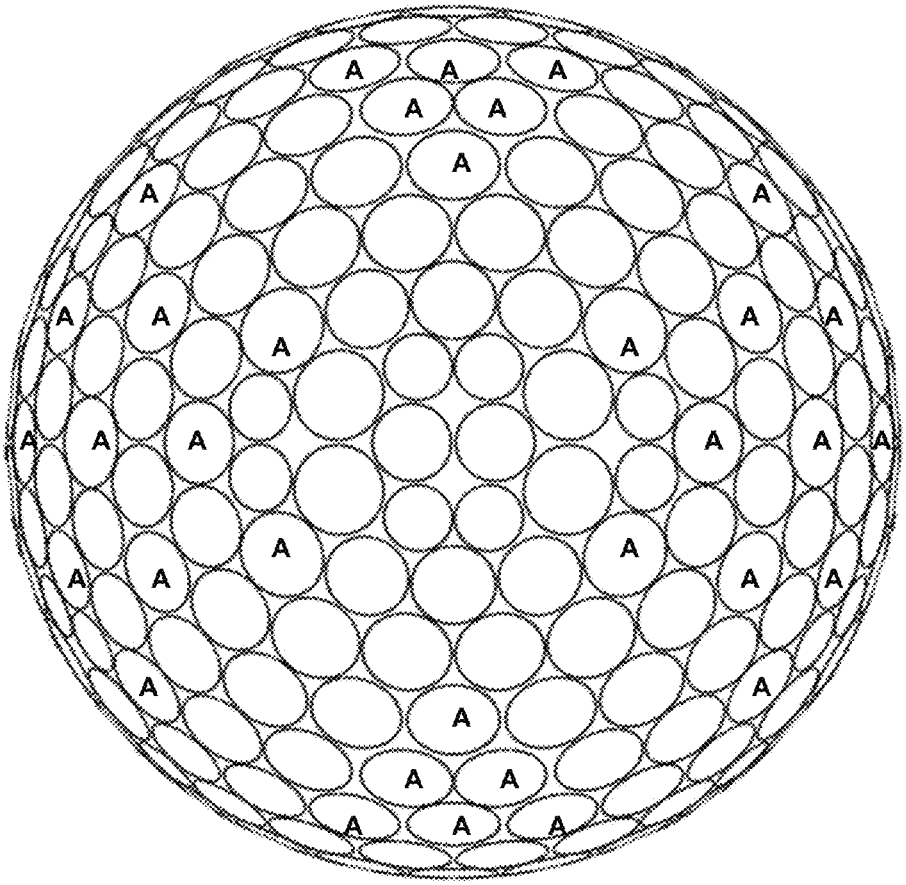
FIG. 4 is a polar view of a golf ball having an arrangement of modified dimples according to another embodiment of the present invention.
Figure 5:
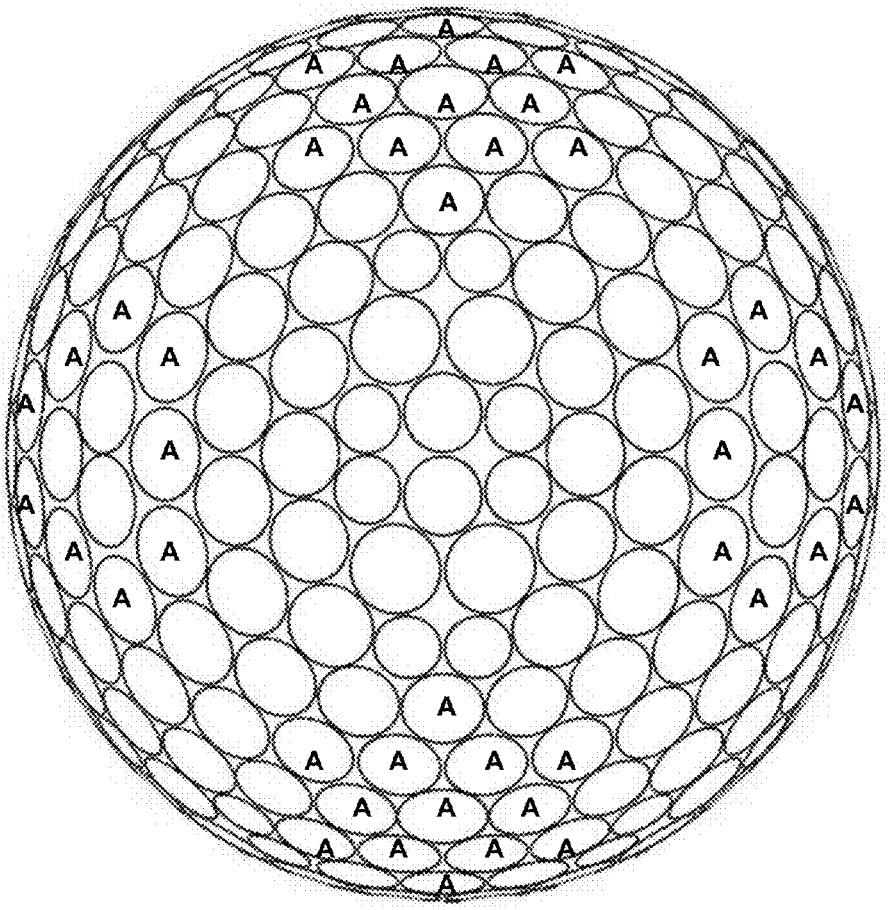
FIG. 5 is a polar view of a golf ball having an arrangement of modified dimples according to another embodiment of the present invention.

Referring now to the figures, FIGS. 1-5 illustrate the polar view of a seamless golf ball having 352 dimples arranged in a tetrahedron-based pattern, with modified dimples designated by the letter A. Each hemisphere of the ball can be divided by imaginary grid lines into two pairs of identical regions, each region having one modified dimple group arranged about a CAC 10 located on a non-polar axis of symmetry at a latitude angle of 54.7°. In FIG. 1, each region of one pair has a modified dimple group consisting of a set of three pairs of modified dimples, and each region of the other pair has a modified dimple group consisting of six modified dimples forming a hexagon. In FIG. 2, each region of one pair has a modified dimple group consisting of seven modified dimples forming a hexagon, and each region of the other pair has a modified dimple group consisting of three modified dimples forming a triangle. In FIG. 3, each region of one pair has a modified dimple group consisting of six modified dimples forming a triangle, and each region of the other pair has a modified dimple group consisting of three modified dimples forming a triangle and a modified dimple at or near the center of the triangle. FIGS. 4 and 5 illustrate two additional non-limiting examples of suitable patterns for modified dimples of the present invention.

Figure 6A:
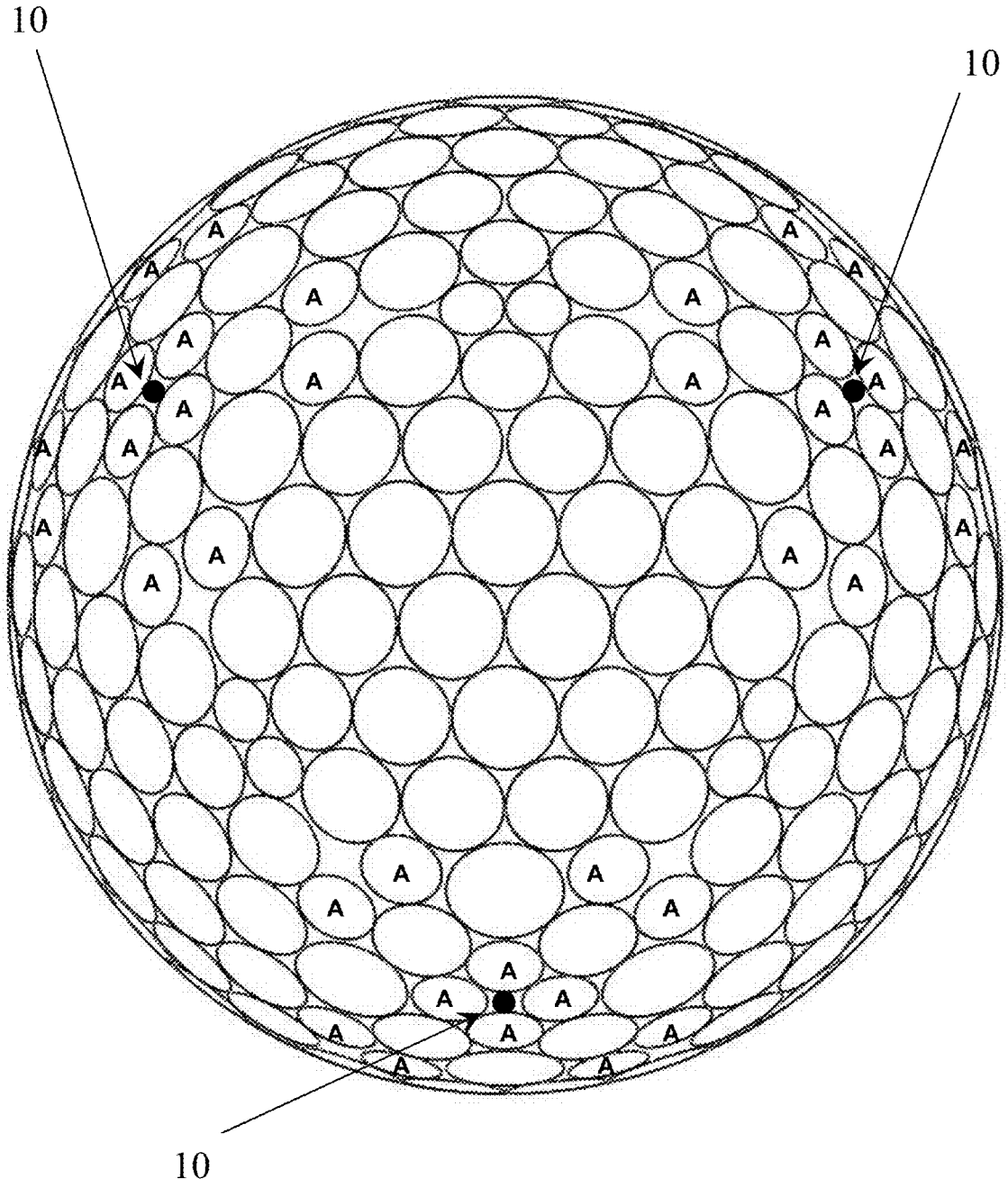
FIG. 6A is a polar view of a golf ball having an arrangement of modified dimples according to another embodiment of the present invention.
Figure 6B:
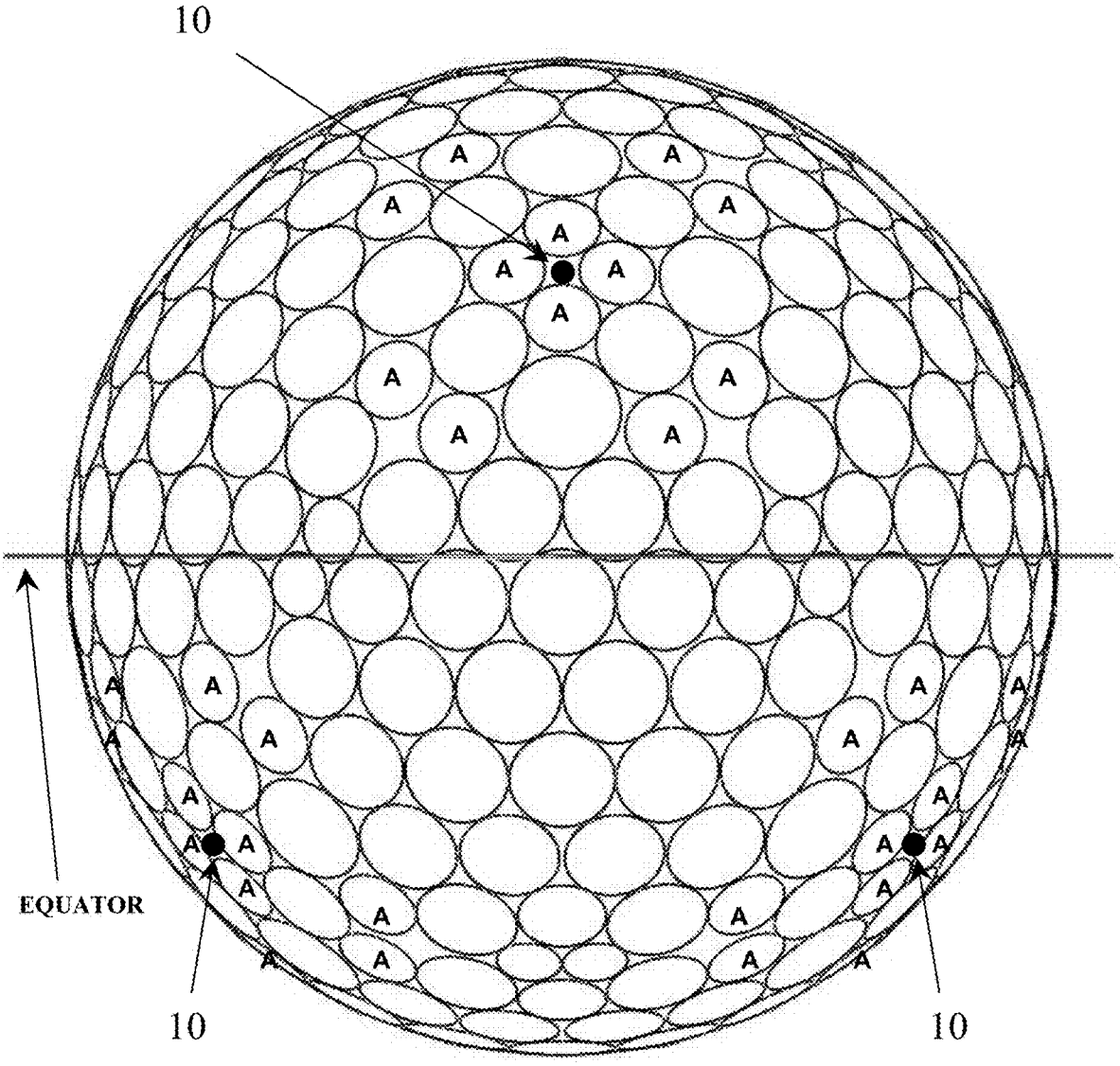
FIG. 6B is an equatorial view of the golf ball illustrated in FIG. 6A.

FIG. 6A illustrates the polar view of a seamless golf ball having 360 dimples arranged in a cuboctahedron-based pattern, with modified dimples designated by the letter A. Each hemisphere of the ball can be divided by imaginary grid lines into three identical regions, each region having one modified dimple group arranged about a CAC 10 located on a non-polar axis of symmetry at a latitude angle of 54.7°. The modified dimple group of each region consists of four modified dimples forming a square and a set of four pairs of modified dimples forming a square. FIG. 6B is an equatorial view of the golf ball illustrated in FIG. 6A.

Figure 7A:
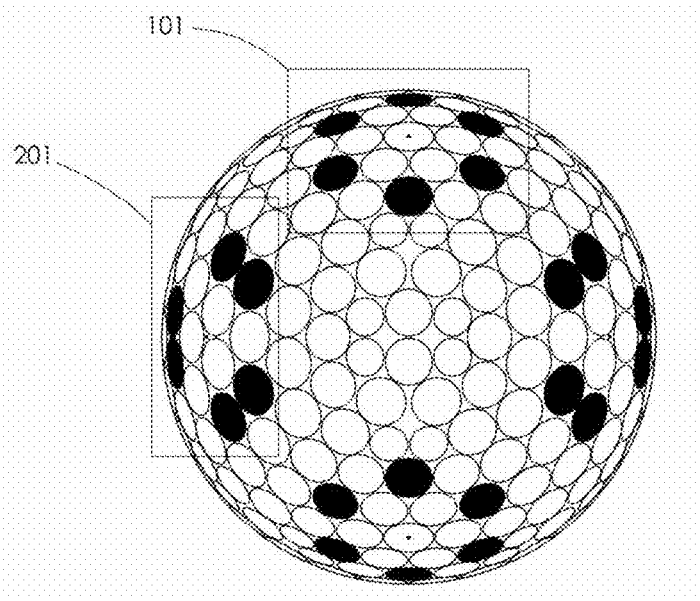
FIG. 7A is a polar view of a golf ball having an arrangement of modified dimples according to an embodiment of the present invention.
Figure 7B:
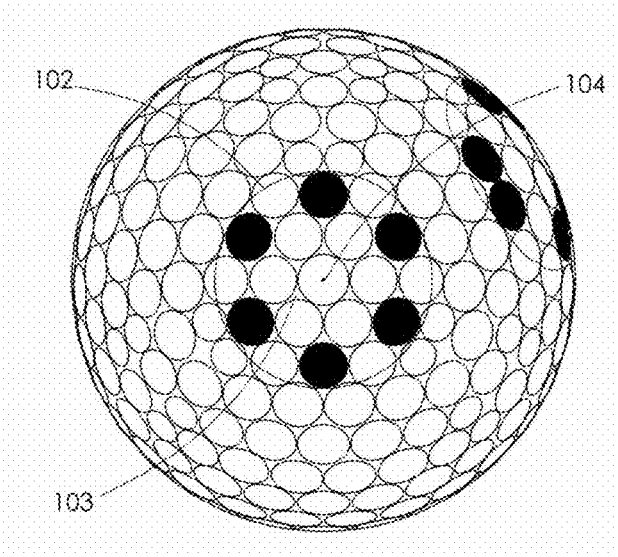
FIG. 7B is a first alternate view of the golf ball illustrated in FIG. 7A.
Figure 7C:
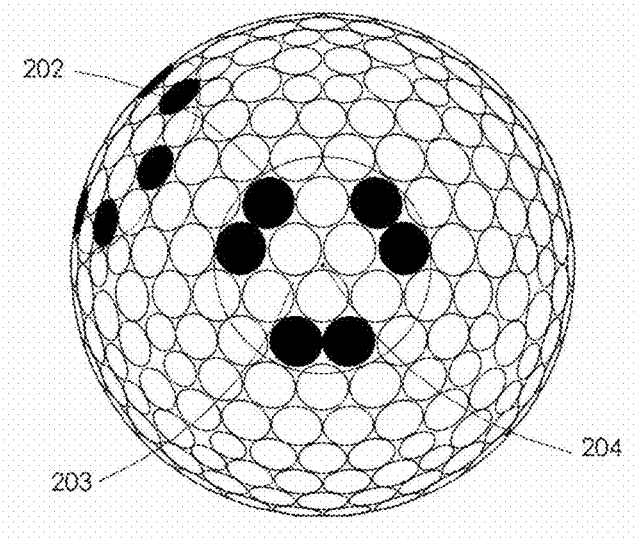
FIG. 7C is a second alternate view of the golf ball illustrated in FIG. 7A.

FIGS. 7A-7C illustrate a seamless golf ball having 352 dimples arranged in a tetrahedron-based pattern, with modified dimples designated by shading. FIG. 7A is a polar view of the golf ball. The modified dimples within the area designated 101 form a first modified dimple group having an axially symmetric pattern about a CAC 104. The modified dimples within the area designated 201 form a second modified dimple group having an axially symmetric pattern about a CAC 204. The ball can be divided by imaginary grid lines into four quarter-spheres, each quarter-sphere including a modified dimple group having a pattern identical to that of the first modified dimple group and a modified dimple group having a pattern identical to that of the second modified dimple group.

FIG. 7B is a planar view of the golf ball normal to the axis containing the CAC 104. FIG. 7B shows an imaginary circle 102 circumscribing the first modified dimple group, and the fret 103 of the first modified dimple group, i.e., the surface of the golf ball within circle 102 not covered by dimples.

FIG. 7C is a planar view of the golf ball normal to the axis containing the CAC 204. FIG. 7C shows an imaginary circle 202 circumscribing the second modified dimple group, and the fret 203 of the second modified dimple group, i.e., the surface of the golf ball within circle 202 not covered by dimples.

In a particular aspect of the embodiment shown in FIGS. 7A-7C, the modified dimples of the first modified dimple group have the same diameter, the modified dimples of the second modified dimple group have the same diameter, but the difference between the diameter of the modified dimples of the first modified dimple group and the diameter of the modified dimples of the second modified dimple group is 0.015 inches. The ratio of the diameter of circumscribing circle 102 to the diameter of circumscribing circle 202 is 0.997. The ratio of the surface area of the fret 103 to the surface area of the fret 203 is 0.920.

Figure 8A:
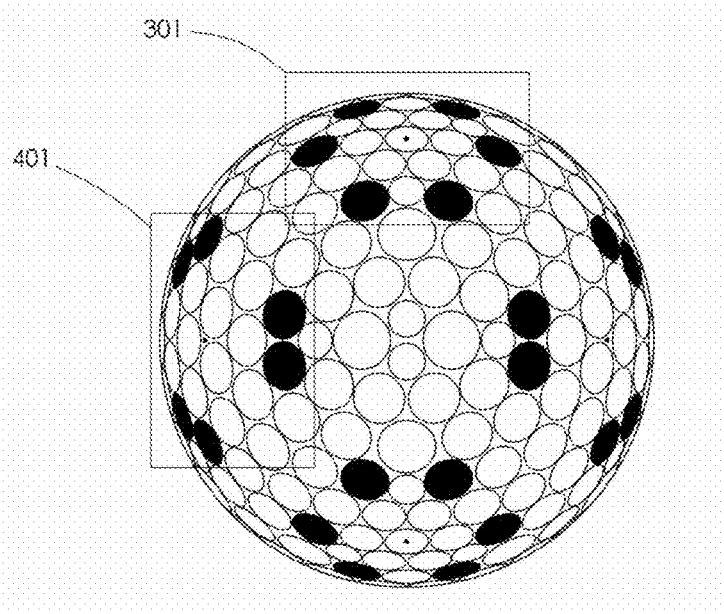
FIG. 8A is a polar view of a golf ball having an arrangement of modified dimples according to an embodiment of the present invention.
Figure 8B:
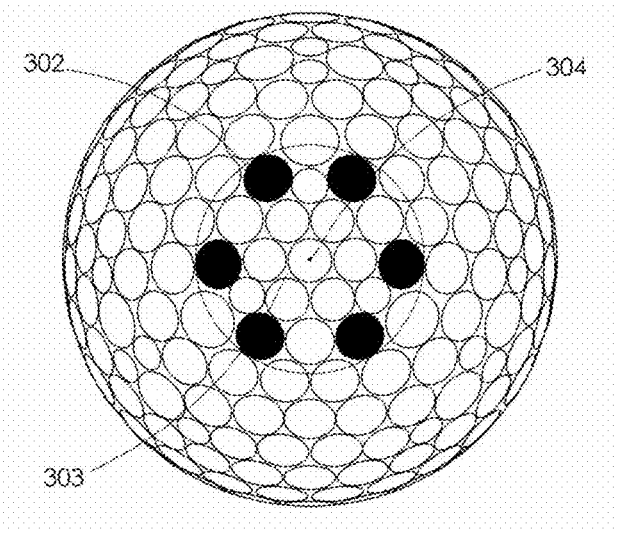
FIG. 8B is a first alternate view of the golf ball illustrated in FIG. 8A.
Figure 8C:
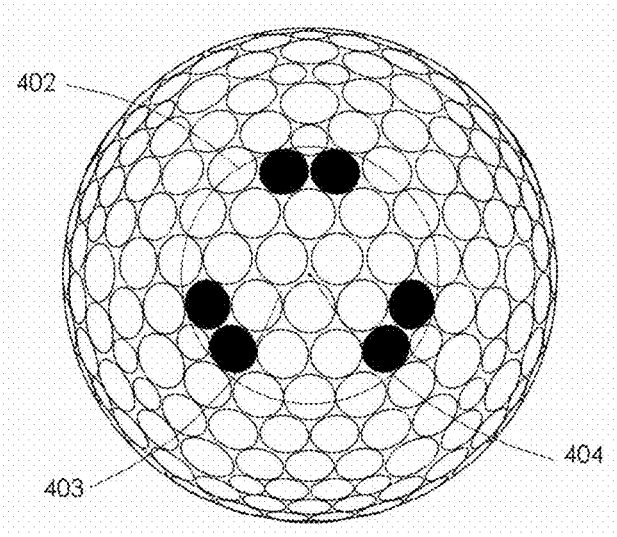
FIG. 8C is a second alternate view of the golf ball illustrated in FIG. 8A.

FIGS. 8A-8C illustrate a seamless golf ball having 328 dimples arranged in a tetrahedron-based pattern, with modified dimples designated by shading. FIG. 8A is a polar view of the golf ball. The modified dimples within the area designated 301 form a first modified dimple group having an axially symmetric pattern about a CAC 304. The modified dimples within the area designated 401 form a second modified dimple group having an axially symmetric pattern about a CAC 404. The ball can be divided by imaginary grid lines into four quarter-spheres, each quarter-sphere including a modified dimple group having a pattern identical to that of the first modified dimple group and a modified dimple group having a pattern identical to that of the second modified dimple group.

FIG. 8B is a planar view of the golf ball normal to the axis containing the CAC 304. FIG. 8B shows an imaginary circle 302 circumscribing the first modified dimple group, and the fret 303 of the first modified dimple group, i.e., the surface of the golf ball within circle 302 not covered by dimples.

FIG. 8C is a planar view of the golf ball normal to the axis containing the CAC 404. FIG. 8C shows an imaginary circle 402 circumscribing the second modified dimple group, and the fret 403 of the second modified dimple group, i.e., the surface of the golf ball within circle 402 not covered by dimples.

In a particular aspect of the embodiment shown in FIGS. 8A-8C, the modified dimples of the first modified dimple group and the modified dimples of the second modified dimple group have the same diameter. The ratio of the diameter of circumscribing circle 302 to the diameter of circumscribing circle 402 is 0.890. The ratio of the surface area of the fret 303 to the surface area of the fret 403 is 0.834.

Figure 9A:
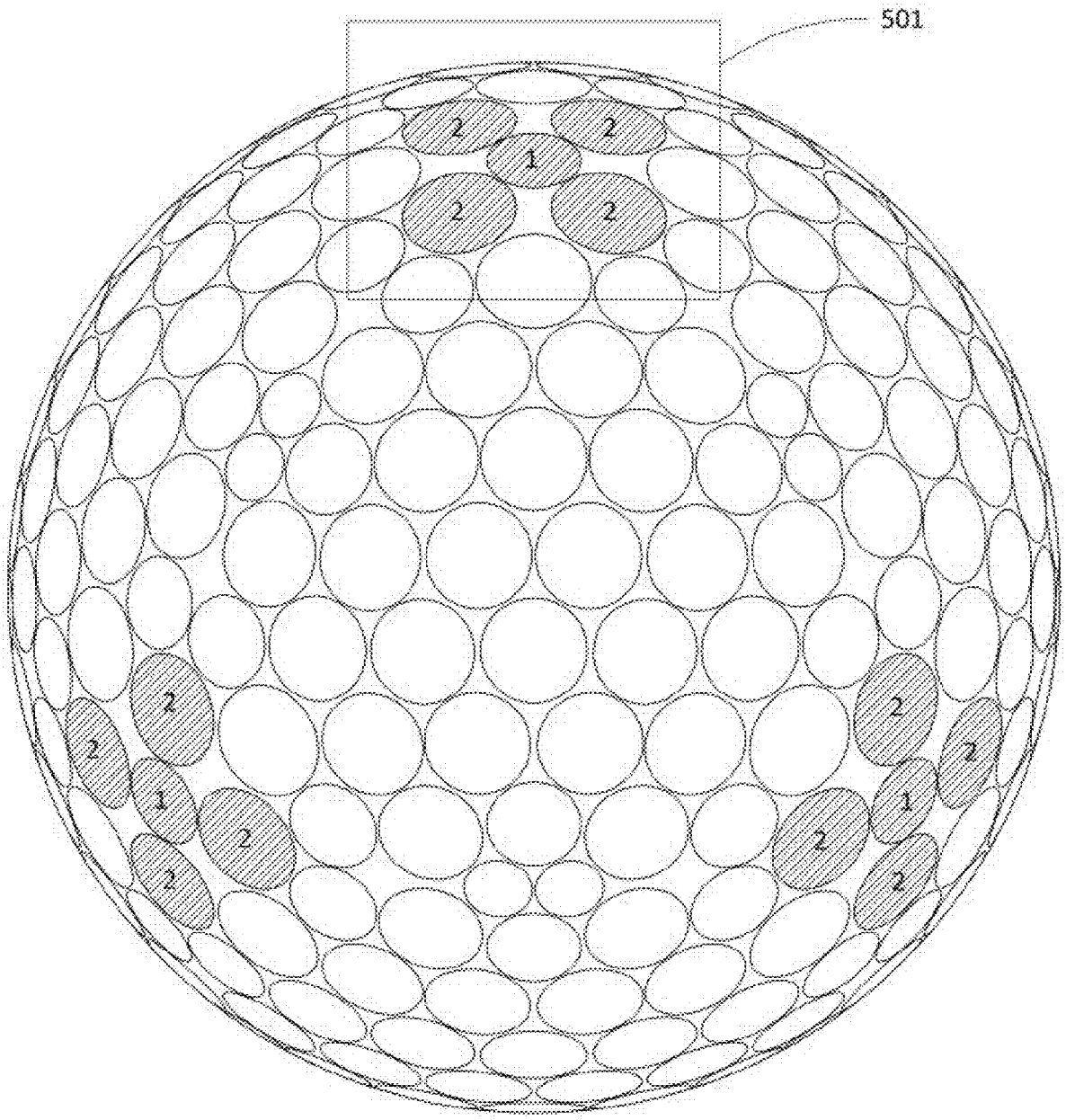
FIG. 9A is a polar view of a golf ball having an arrangement of modified dimples according to an embodiment of the present invention.
Figure 9B:
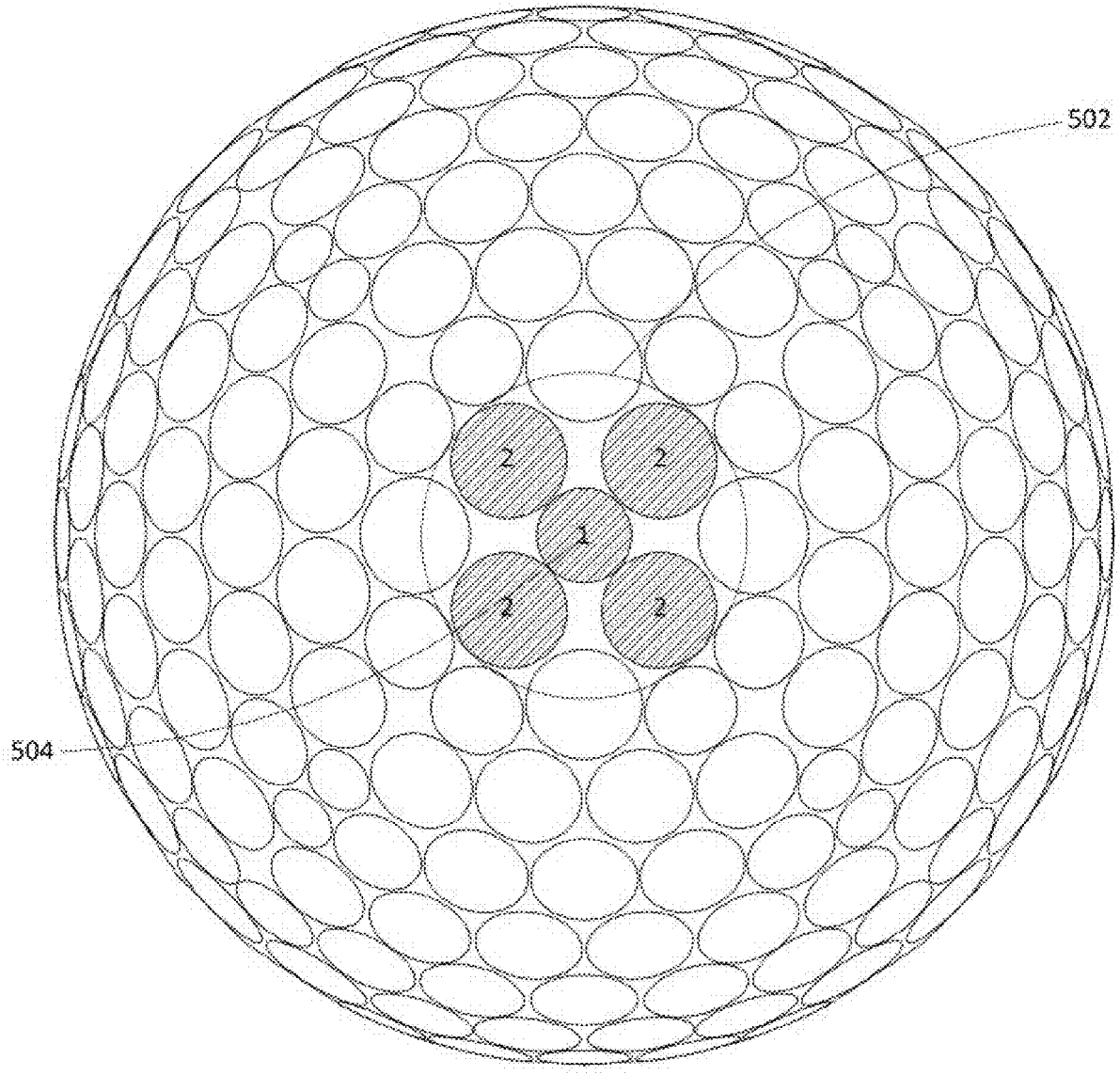
FIG. 9B is an alternate view of the golf ball illustrated in FIG. 9A.

FIGS. 9A-9B illustrate a seamless golf ball having 342 dimples, with modified dimples designated by shading. In a particular aspect of the embodiment illustrated in FIGS. 9A-9B, the unmodified (i.e., unshaded) dimples have the same edge angle and the modified (i.e., shaded) dimples have an edge angle that is from 1° to 4° different than the edge angle of the unmodified dimples. The numerical labels within the shaded dimples designate same diameter dimples. For example, all dimples labelled 1 have the same diameter, and all dimples labelled 2 have the same diameter. In a particular aspect of the embodiment illustrated in FIGS. 9A-9B, the dimples labelled 1 have a diameter of about 0.150 inches, and the dimples labelled 2 have a diameter of about 0.185 inches.

In FIGS. 9A-9B, the modified dimples within the area designated 501 form a modified dimple group having an axially symmetric pattern about a CAC 504. The ball can be divided into two hemispheres having identical dimple patterns; each hemisphere can be divided into three regions having identical dimple patterns; and each region has a modified dimple group identical to the group of modified dimples within the area designated 501. Each modified dimple group includes a modified dimple having a center that is coincident with the CAC 504.

FIG. 9A is a polar view of the golf ball. FIG. 9B is an alternate view of the golf ball illustrated in FIG. 9A. More specifically, FIG. 9B is a planar view of the golf ball normal to the axis containing the CAC 504. FIG. 9B shows an imaginary circle 502 circumscribing the modified dimple group and having a diameter of about 0.518 inches.

Figure 10A:
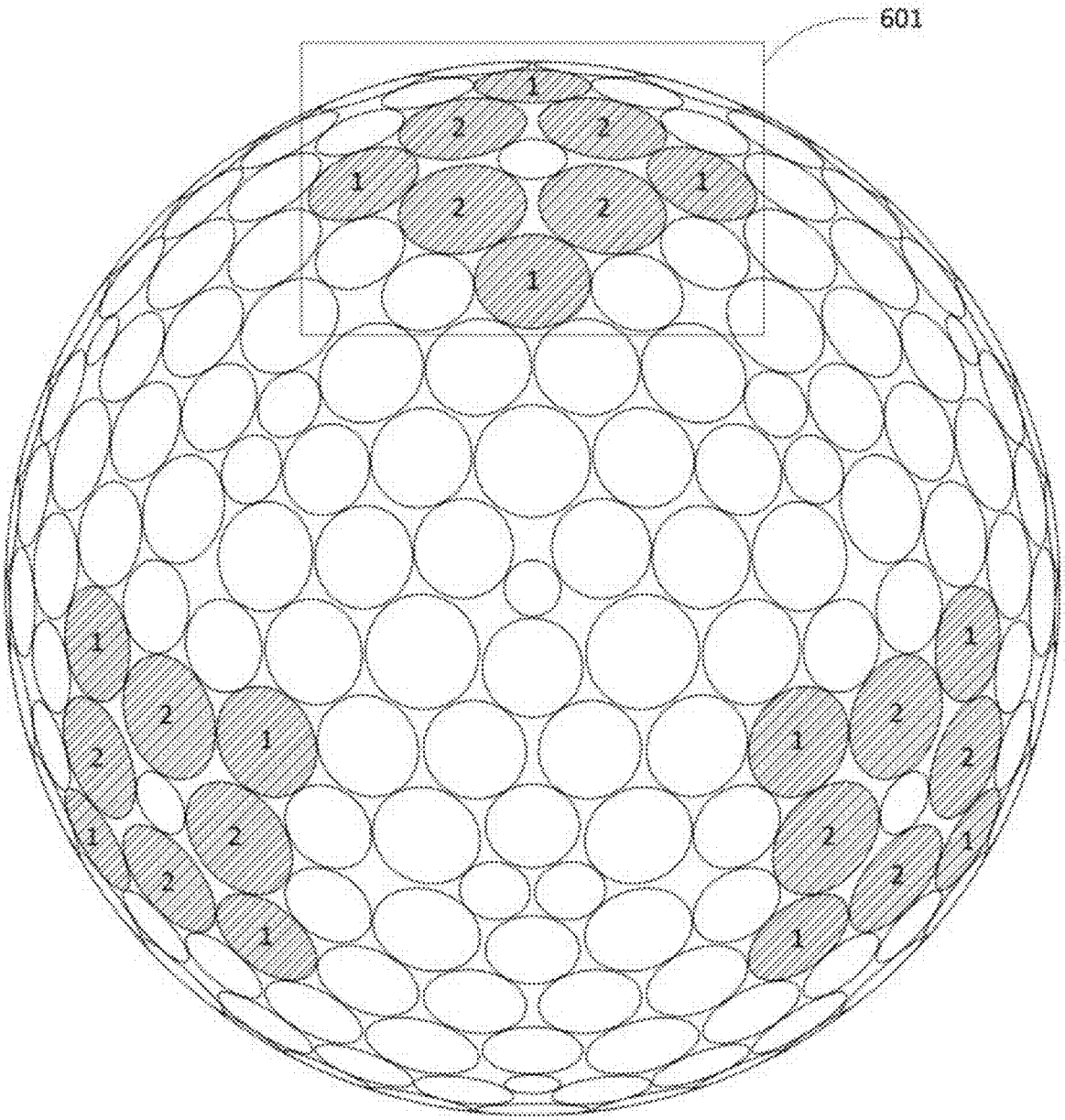
FIG. 10A is a polar view of a golf ball having an arrangement of modified dimples according to an embodiment of the present invention.
Figure 10B:
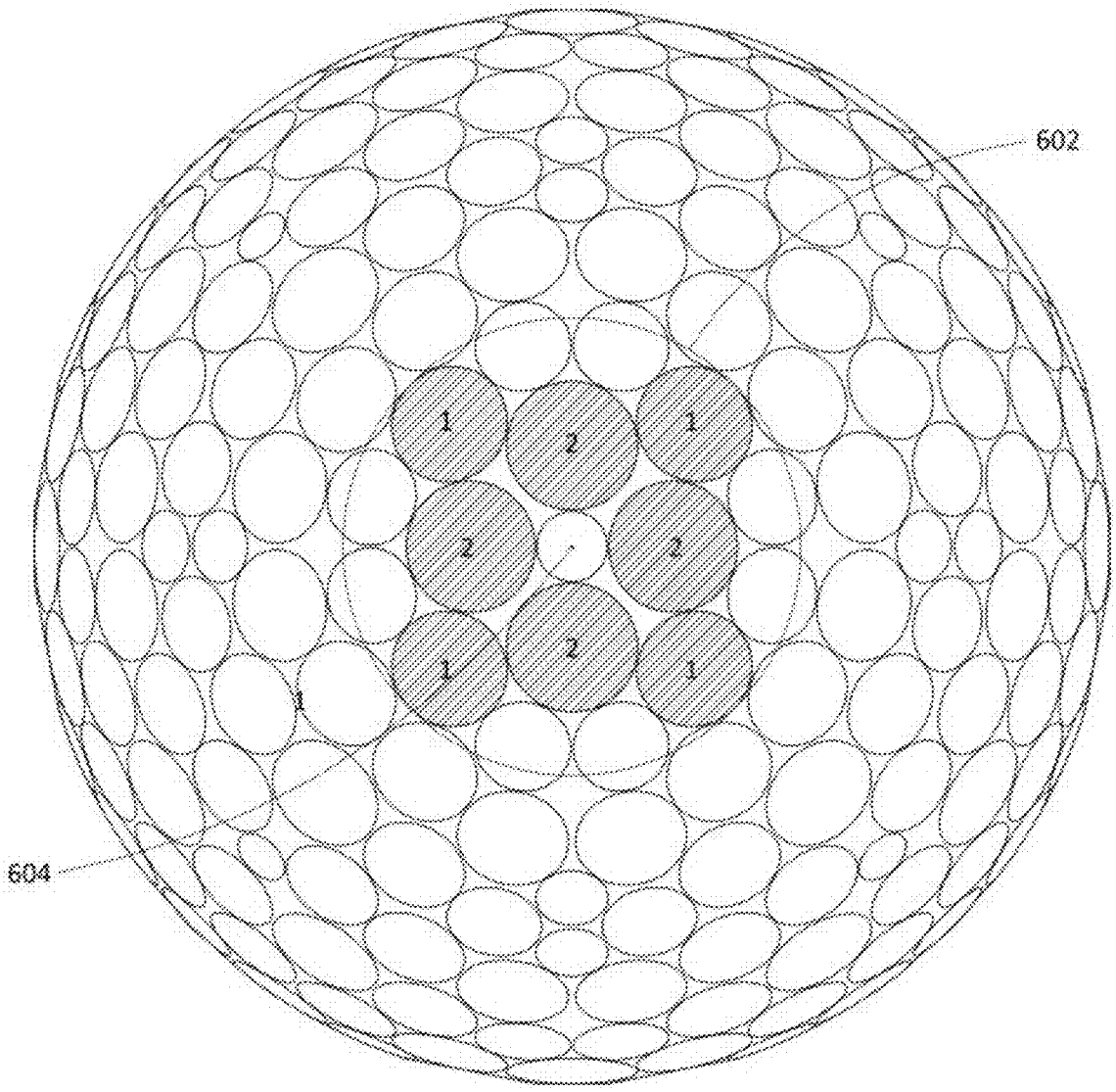
FIG. 10B is an alternate view of the golf ball illustrated in FIG. 10A.

FIGS. 10A-10B illustrate a seamless golf ball having 350 dimples, with modified dimples designated by shading. In a particular aspect of the embodiment illustrated in FIGS. 10A-10B, the unmodified (i.e., unshaded) dimples have the same edge angle and the modified (i.e., shaded) dimples have an edge angle that is from 1° to 4° different than the edge angle of the unmodified dimples. The numerical labels within the shaded dimples designate same diameter dimples. For example, all dimples labelled 1 have the same diameter, and all dimples labelled 2 have the same diameter. In a particular aspect of the embodiment illustrated in FIGS. 10A-10B, the dimples labelled 1 have a diameter of about 0.185 inches, and the dimples labelled 2 have a diameter of about 0.205 inches.

In FIGS. 10A-10B, the modified dimples within the area designated 601 form a modified dimple group having an axially symmetric pattern about a CAC 604. The ball can be divided into two hemispheres having identical dimple patterns; each hemisphere can be divided into three regions having identical dimple patterns; and each region has a modified dimple group identical to the group of modified dimples within the area designated 601. Each modified dimple group includes an unmodified dimple having a center that is coincident with the CAC 604.

FIG. 10A is a polar view of the golf ball. FIG. 10B is an alternate view of the golf ball illustrated in FIG. 10A. More specifically, FIG. 10B is a planar view of the golf ball normal to the axis containing the CAC 604. FIG. 10B shows an imaginary circle 602 circumscribing the modified dimple group and having a diameter of about 0.715 inches.

Figure 11A:
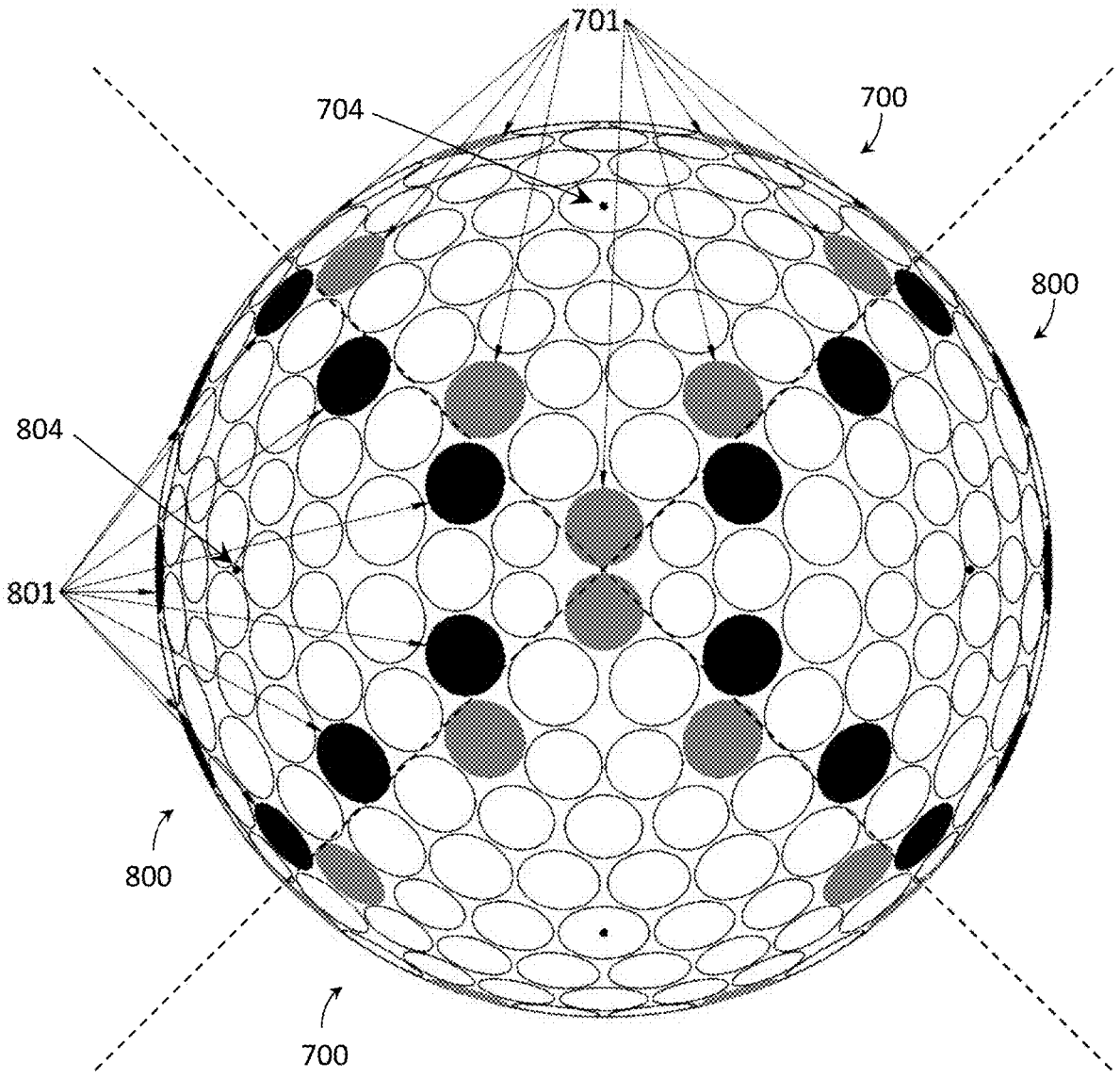
FIG. 11A is a polar view of a golf ball having an overall dimple pattern according to an embodiment of the present invention.
Figure 11B:
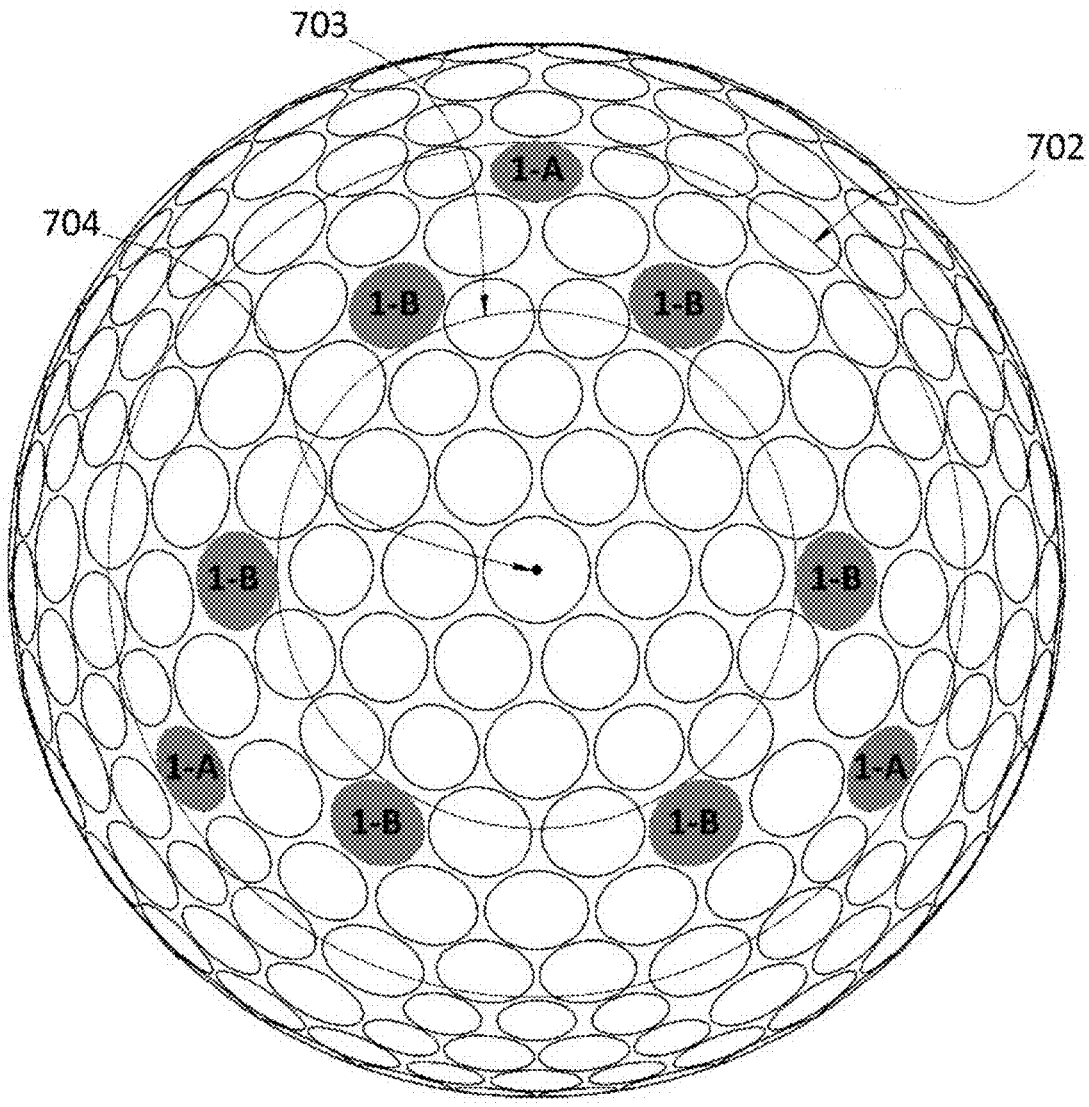
FIG. 11B is a first alternative view of the golf ball illustrated in FIG. 11A.
Figure 11C:
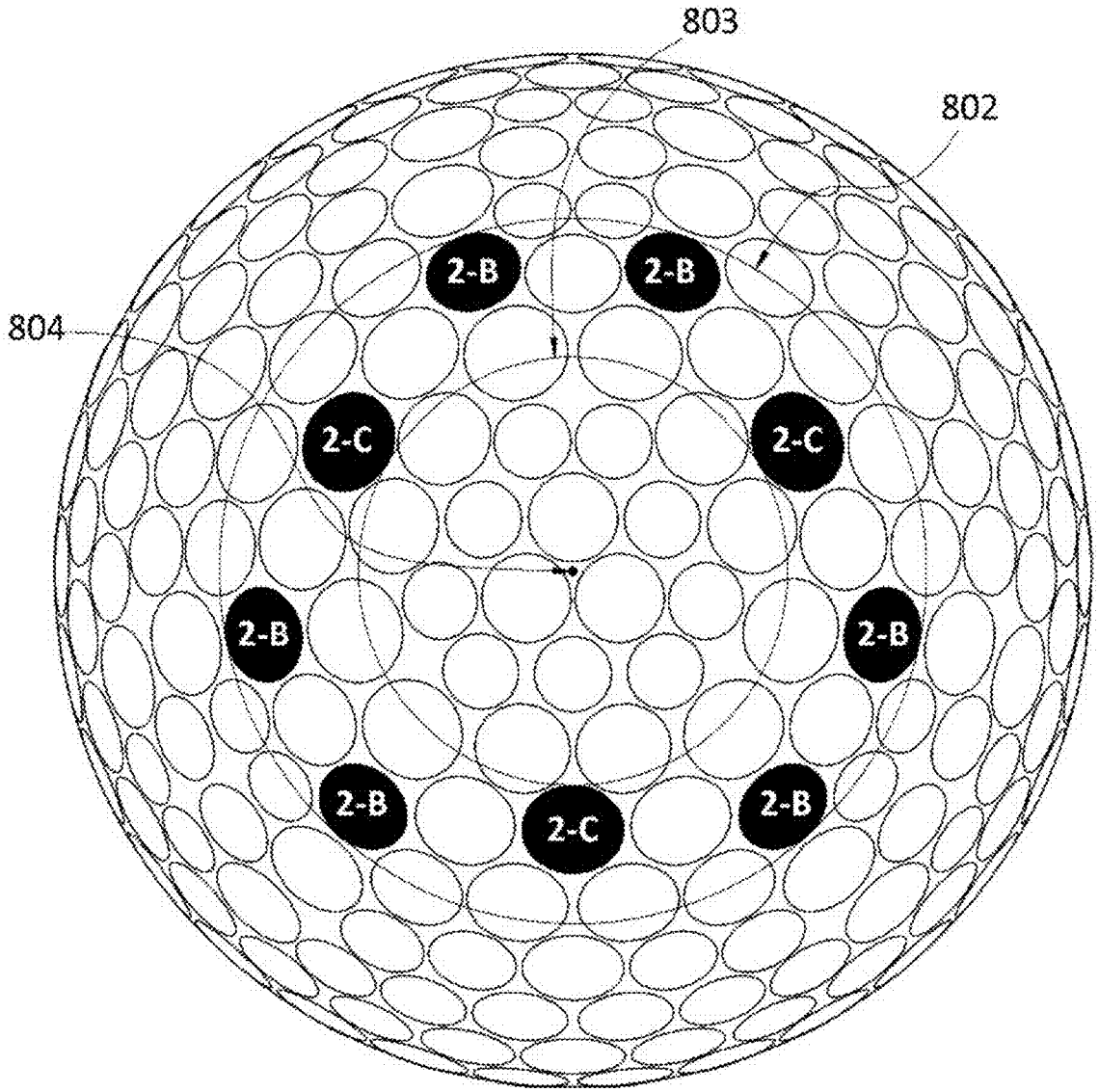
FIG. 11C is a second alternative view of the golf ball illustrated in FIG. 11A.

FIGS. 11A-11C illustrate a seamless golf ball having 376 dimples arranged in a tetrahedron-based pattern, with modified dimples designated by shading. FIG. 11A is a polar view of the golf ball, and shows the dimple pattern of one of the two identical hemispheres divided by reference grid lines into two identical first regions 700 and two identical second regions 800. The modified dimples 701 within the first region 700 form a modified dimple group having an axially symmetric pattern about a CAC 704. The modified dimples 801 within the second region 800 form a modified dimple group having an axially symmetric pattern about a CAC 804.

FIG. 11B is a planar view of the golf ball normal to the axis containing the CAC 704. FIG. 11B shows a reference circle 702 circumscribing the modified dimple group of first region 700, and a reference circle 703 inscribing the modified dimple group of first region 700. Each modified dimple of the modified dimple group of first region 700 is labelled either 1-A or 1-B.

FIG. 11C is a planar view of the golf ball normal to the axis containing the CAC 804. FIG. 11C shows a reference circle 802 circumscribing the modified dimple group of second region 800, and a reference circle 803 inscribing the modified dimple group of second region 800. Each modified dimple of the modified dimple group of second region 800 is labelled either 2-B or 2-C.

In a particular embodiment of the dimple pattern illustrated in FIGS. 11A-11C, the unmodified (i.e., unshaded) dimples have an edge angle of about 14.0°, and the modified dimple groups and the modified dimples within those groups have the properties given in Tables 1 and 2 below.

TABLE 1

| Modified Dimple Group | Circumscribing Diameter (in) | Inscribing Diameter (in) | Modified Group Area ($in^2$) | Average Dimple Diameter (in) |
|---|---|---|---|---|
| first region 700 | 1.363 | 0.825 | 0.925 | 0.152 |
| second region 800 | 1.146 | 0.696 | 0.651 | 0.158 |

TABLE 2

| Modified Dimple Label | Dimple Edge Angle (°) | Dimple Diameter (in) |
|---|---|---|
| 1-A | 13.0 | 0.145 |
| 1-B | 13.0 | 0.155 |
| 2-B | 13.0 | 0.155 |
| 2-C | 13.0 | 0.165 |

Figure 13A:
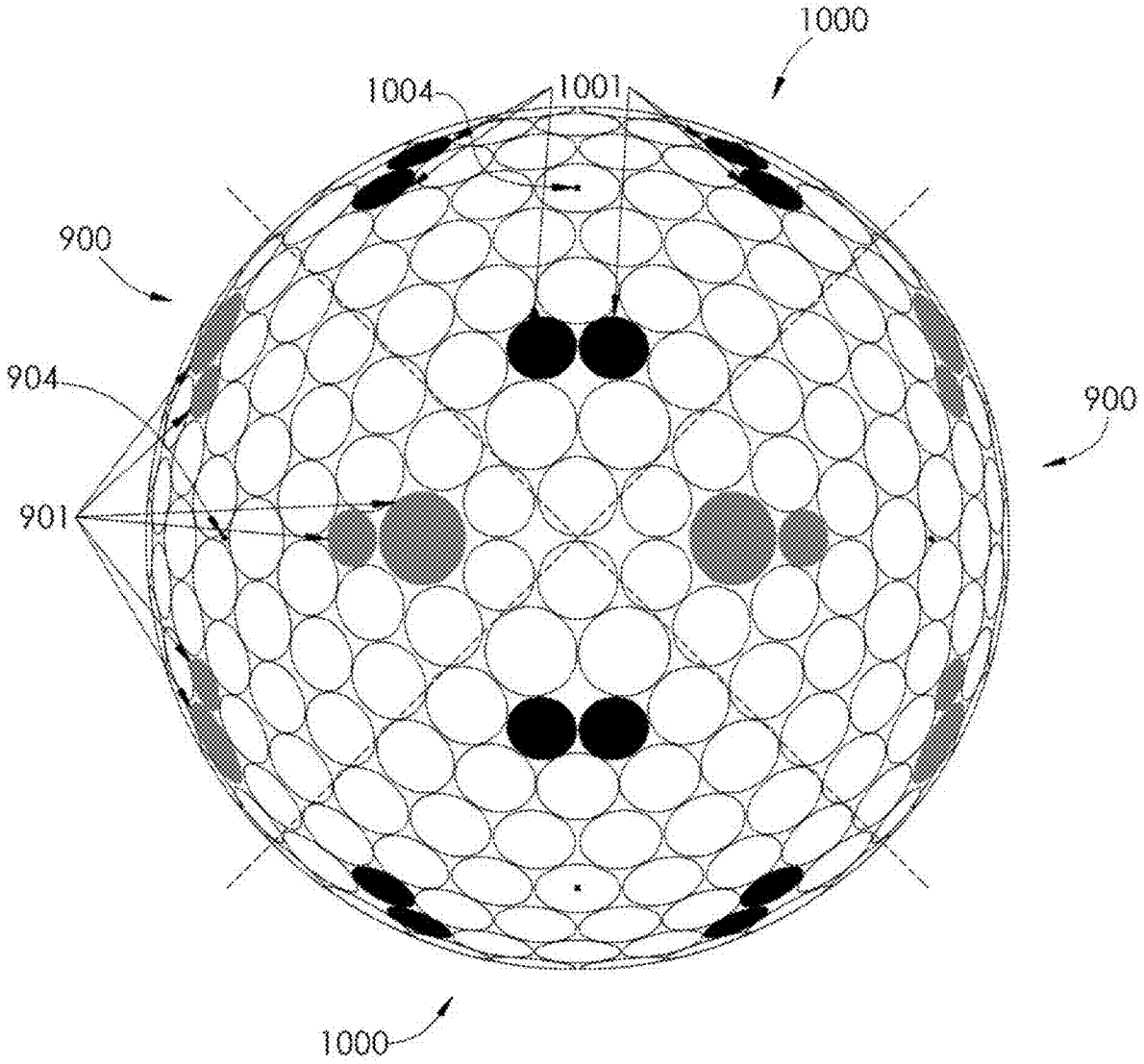
FIG. 13A is a polar view of a golf ball having an overall dimple pattern according to an embodiment of the present invention.
Figure 13B:
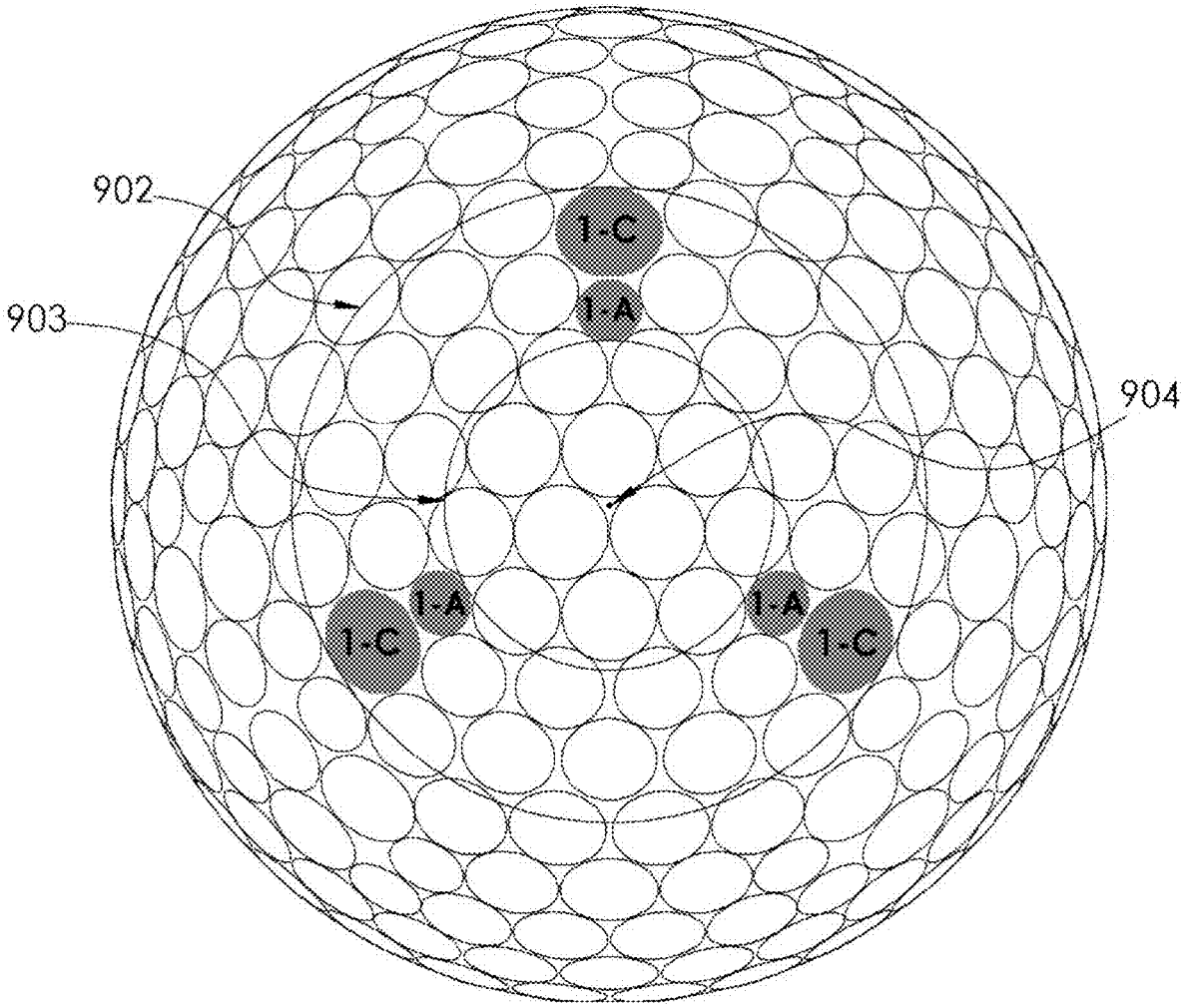
FIG. 13B is a first alternative view of the golf ball illustrated in FIG. 13A.
Figure 13C:
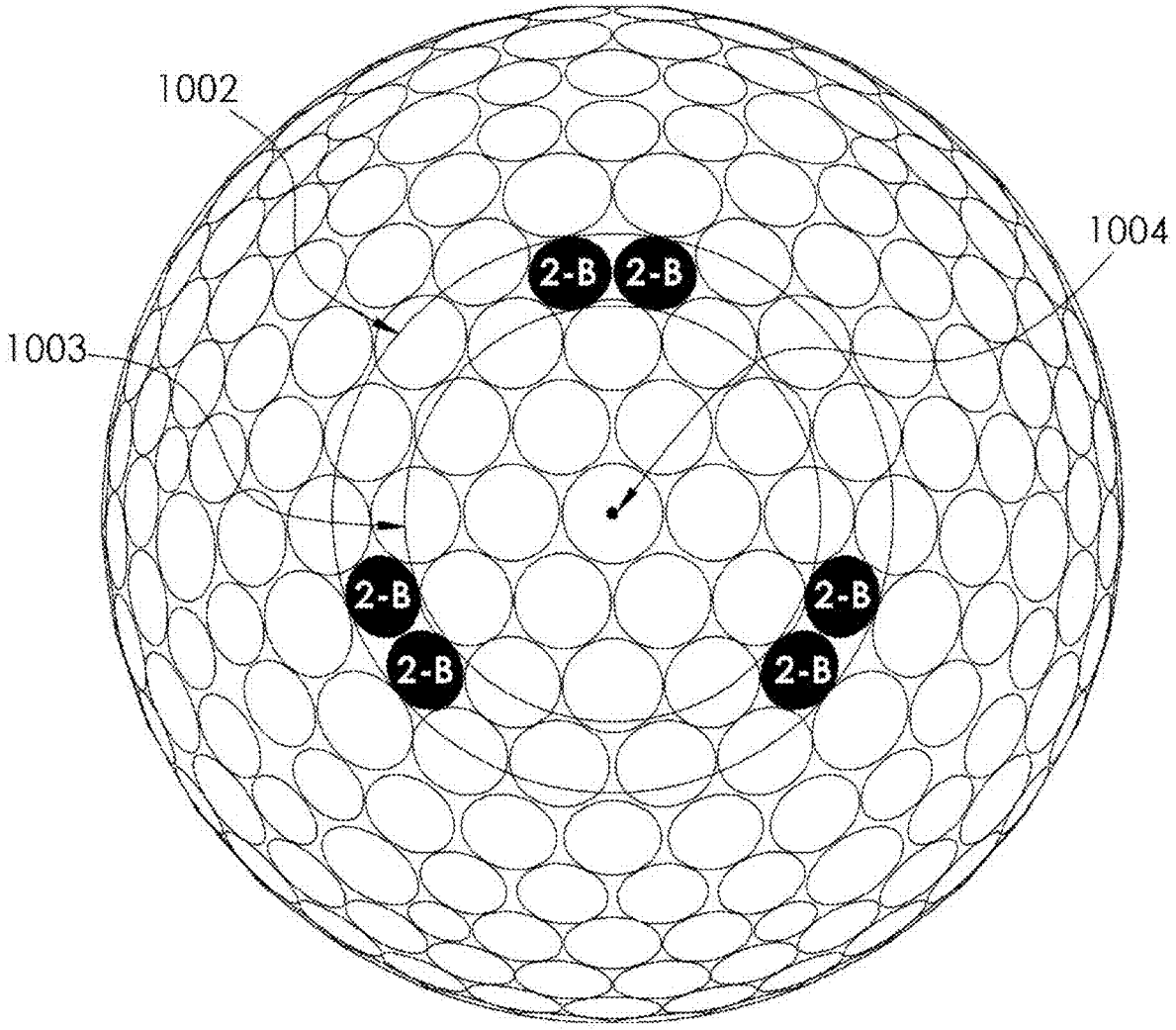
FIG. 13C is a second alternative view of the golf ball illustrated in FIG. 13A.

FIGS. 13A-13C illustrate a seamless golf ball having 388 dimples arranged in a tetrahedron-based pattern, with modified dimples designated by shading. FIG. 13A is a polar view of the golf ball, and shows the dimple pattern of one of the two identical hemispheres divided by reference grid lines into two identical first regions 900 and two identical second regions 1000. The modified dimples 901 within the first region 900 form a modified dimple group having an axially symmetric pattern about a CAC 904. The modified dimples 1001 within the second region 1000 form a modified dimple group having an axially symmetric pattern about a CAC 1004.

FIG. 13B is a planar view of the golf ball normal to the axis containing the CAC 904. FIG. 13B shows a reference circle 902 circumscribing the modified dimple group of first region 900, and a reference circle 903 inscribing the modified dimple group of first region 900. Each modified dimple of the modified dimple group of first region 900 is labelled either 1-A or 1-C. FIG. 13C is a planar view of the golf ball normal to the axis containing the CAC 1004.

FIG. 13C shows a reference circle 1002 circumscribing the modified dimple group of second region 1000, and a reference circle 1003 inscribing the modified dimple group of second region 1000. Each modified dimple of the modified dimple group of second region 1000 is labelled 2-B.

In a particular embodiment of the dimple pattern illustrated in FIGS. 13A-13C, the unmodified (i.e., unshaded) dimples have an edge angle of about 13.5°, and the modified dimple groups and the modified dimples within those groups have the properties given in Tables 3 and 4 below.

TABLE 3

| Modified Dimple Group | Circumscribing Diameter (in) | Inscribing Diameter (in) | Modified Group Area ($in^2$) | Average Dimple Diameter (in) |
|---|---|---|---|---|
| first region 900 | 1.070 | 0.560 | 0.653 | 0.145 |
| second region 1000 | 0.920 | 0.690 | 0.291 | 0.135 |

TABLE 4

| Modified Dimple Label | Dimple Edge Angle (°) | Dimple Diameter (in) |
|---|---|---|
| 1-A | 12.5 | 0.110 |
| 1-C | 12.5 | 0.180 |
| 2-B | 12.5 | 0.135 |

Figure 14A:
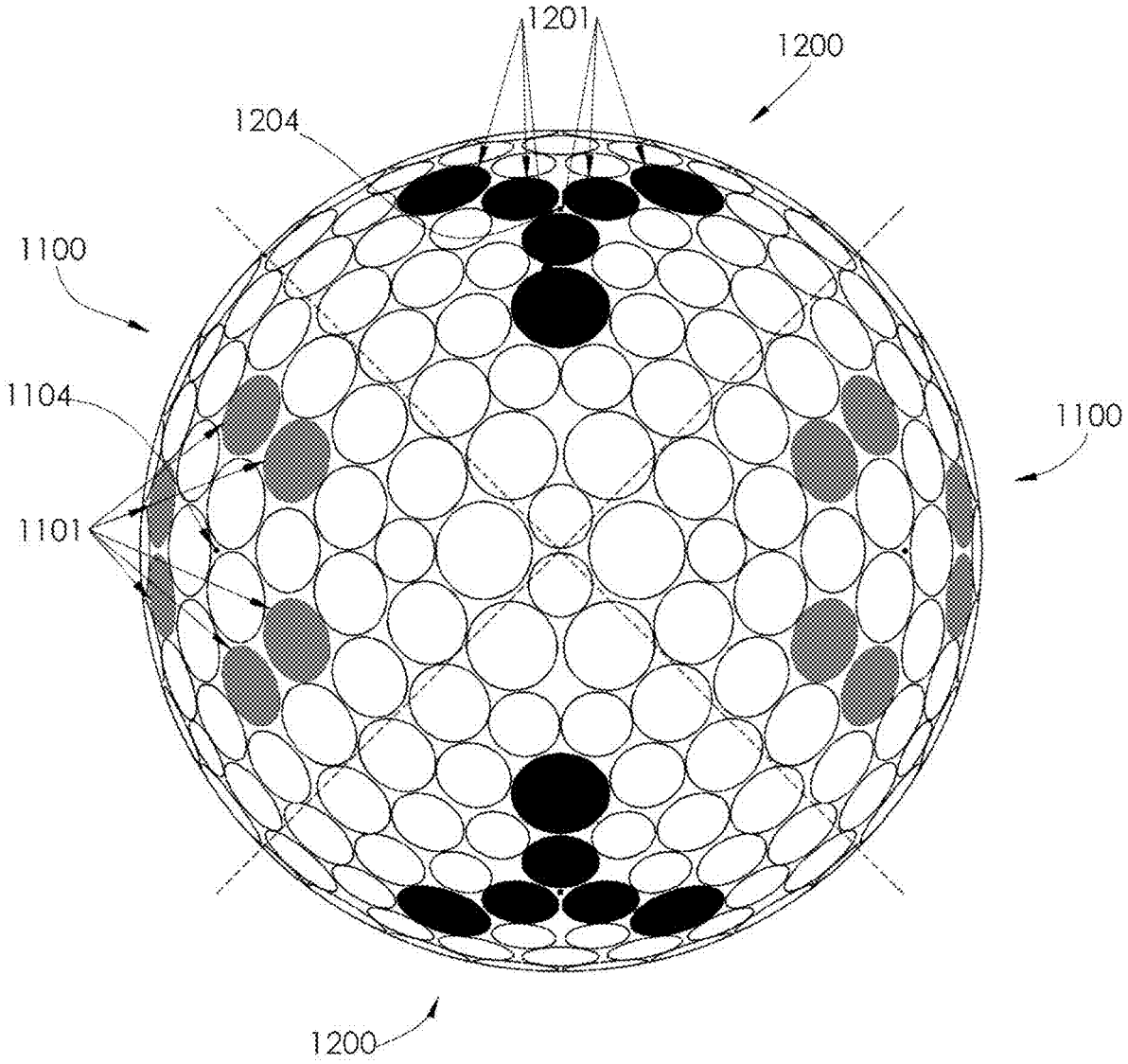
FIG. 14A is a polar view of a golf ball having an overall dimple pattern according to an embodiment of the present invention.
Figure 14B:
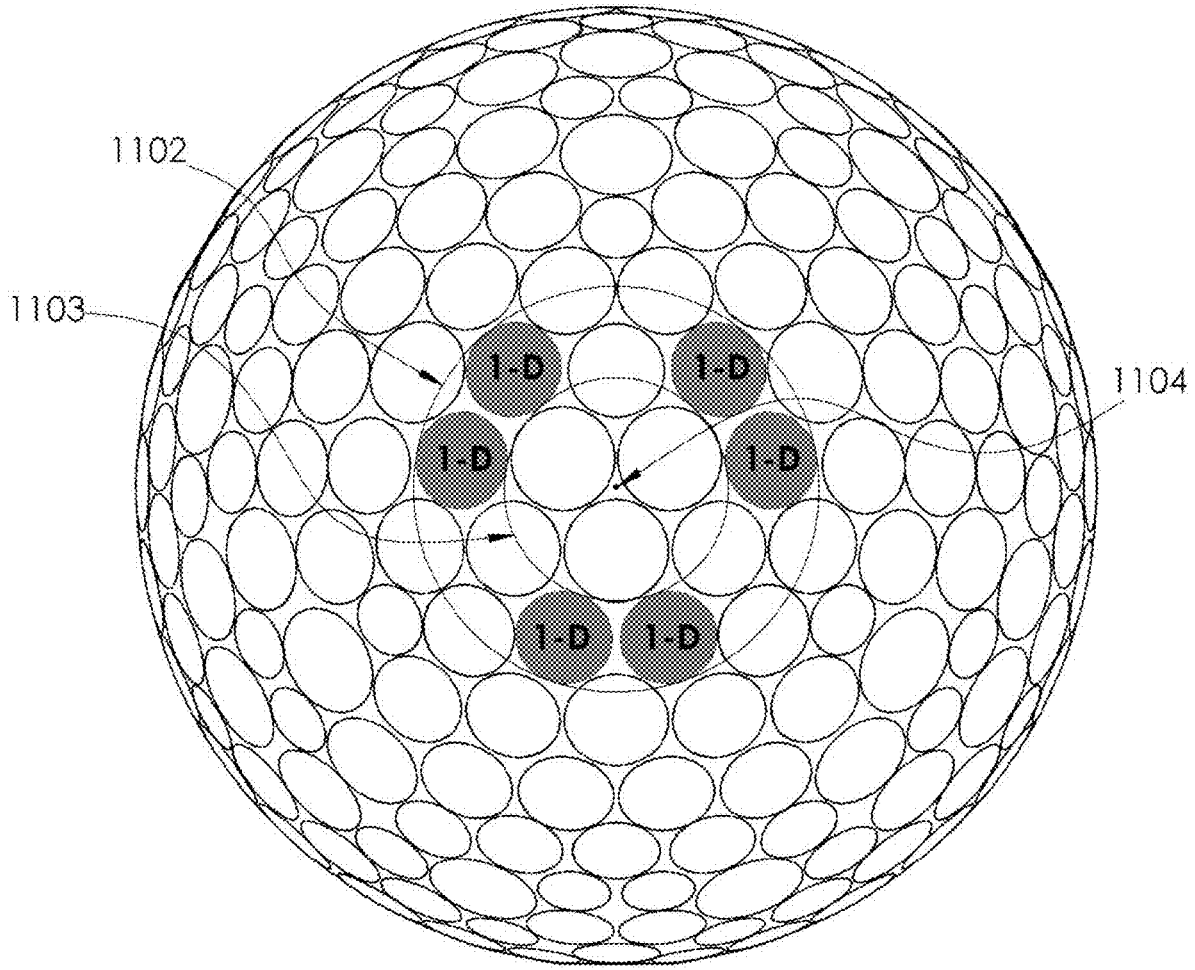
FIG. 14B is a first alternative view of the golf ball illustrated in FIG. 14A.
Figure 14C:
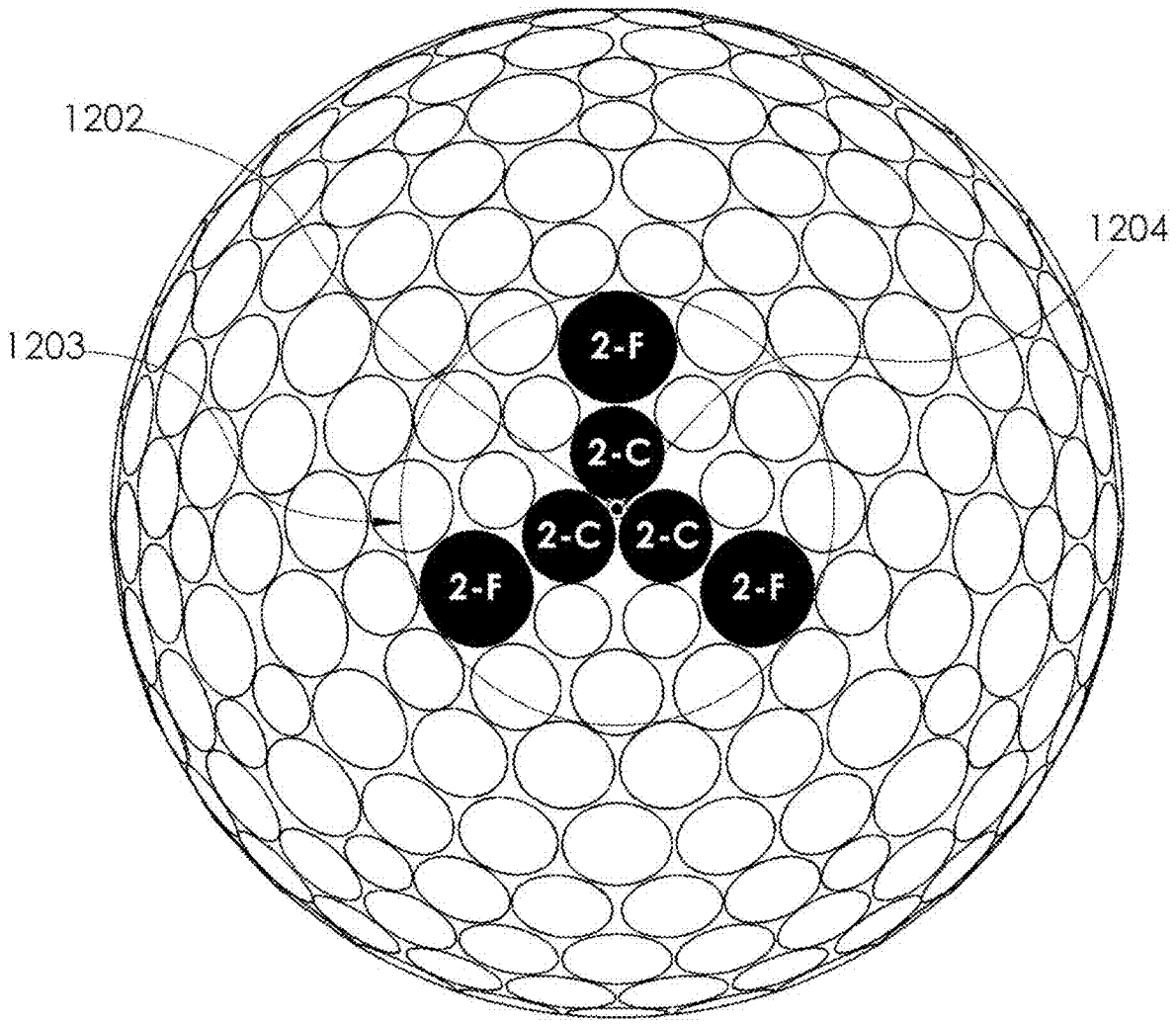
FIG. 14C is a second alternative view of the golf ball illustrated in FIG. 14A.

FIGS. 14A-14C illustrate a seamless golf ball having 348 dimples arranged in a tetrahedron-based pattern, with modified dimples designated by shading. FIG. 14A is a polar view of the golf ball, and shows the dimple pattern of one of the two identical hemispheres divided by reference grid lines into two identical first regions 1200 and two identical second regions 1100. The modified dimples 1201 within the first region 1200 form a modified dimple group having an axially symmetric pattern about a CAC 1204. The modified dimples 1101 within the second region 1100 form a modified dimple group having an axially symmetric pattern about a CAC 1104.

FIG. 14B is a planar view of the golf ball normal to the axis containing the CAC 1104. FIG. 14B shows a reference circle 1102 circumscribing the modified dimple group of second region 1100, and a reference circle 1103 inscribing the modified dimple group of second region 1100. Each modified dimple of the modified dimple group of second region 1100 is labelled 1-D.

FIG. 14C is a planar view of the golf ball normal to the axis containing the CAC 1204. FIG. 14C shows a reference circle 1203 circumscribing the modified dimple group of first region 1200, and a reference circle 1202 inscribing the modified dimple group of first region 1200. Each modified dimple of the modified dimple group of first region 1200 is labelled either 2-C or 2-F.

In a particular embodiment of the dimple pattern illustrated in FIGS. 14A-14C, the unmodified (i.e., unshaded) dimples have an edge angle of about 13.25°, and the modified dimple groups and the modified dimples within those groups have the properties given in Tables 5 and 6 below.

TABLE 5

| Modified Dimple Group | Circumscribing Diameter (in) | Inscribing Diameter (in) | Modified Group Area ($in^2$) | Average Dimple Diameter (in) |
|---|---|---|---|---|
| 1101 | 0.710 | 0.391 | 0.276 | 0.168 |
| 1201 | 0.721 | 0.034 | 0.407 | 0.174 |

TABLE 6

| Modified Dimple Label | Dimple Edge Angle (°) | Dimple Diameter (in) |
|---|---|---|
| 1-D | 12.25 | 0.168 |
| 2-C | 12.25 | 0.153 |
| 2-F | 12.25 | 0.195 |

Figure 15A:
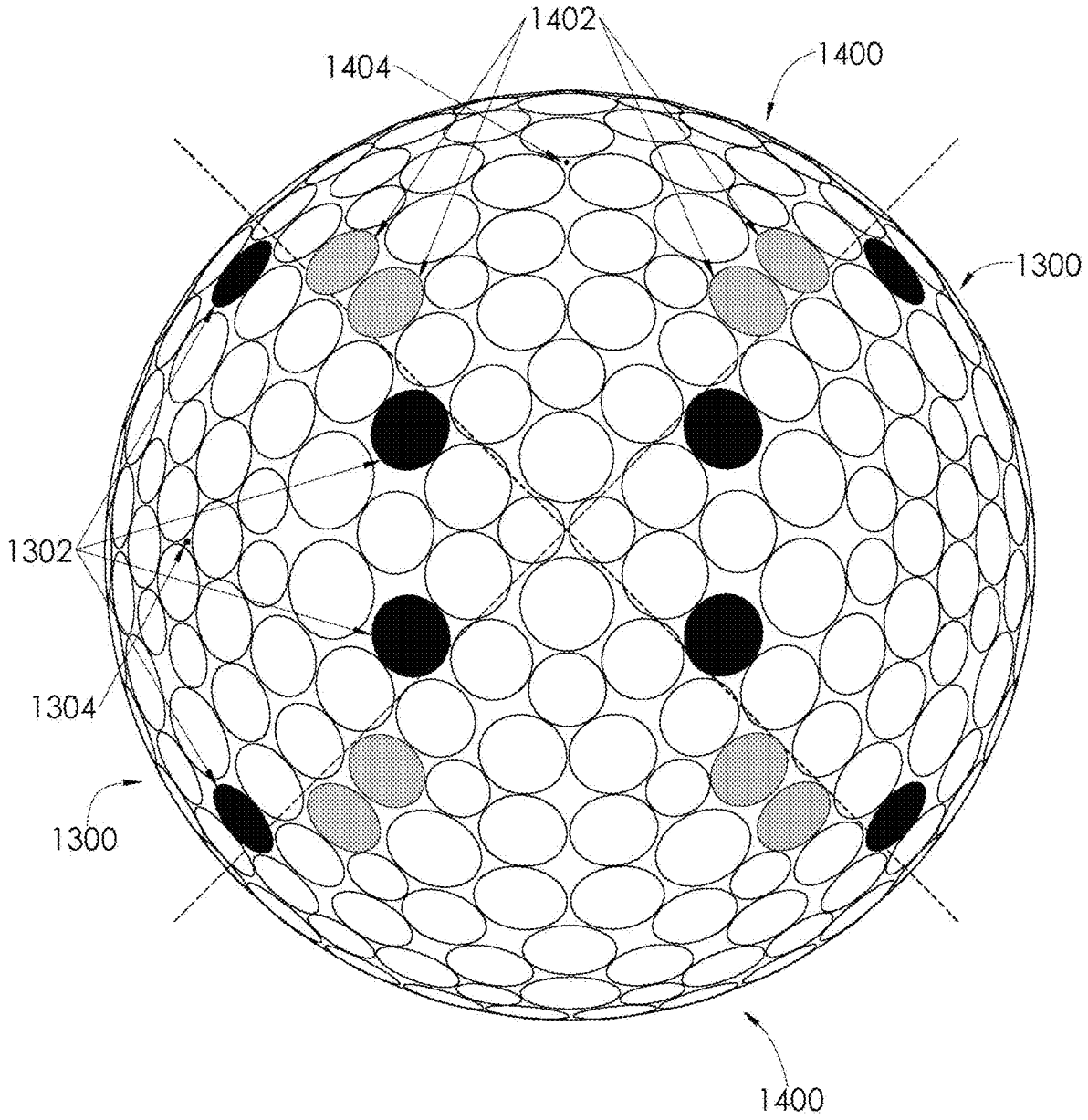
FIG. 15A is a polar view of a golf ball having an overall dimple pattern according to an embodiment of the present invention.
Figure 15B:
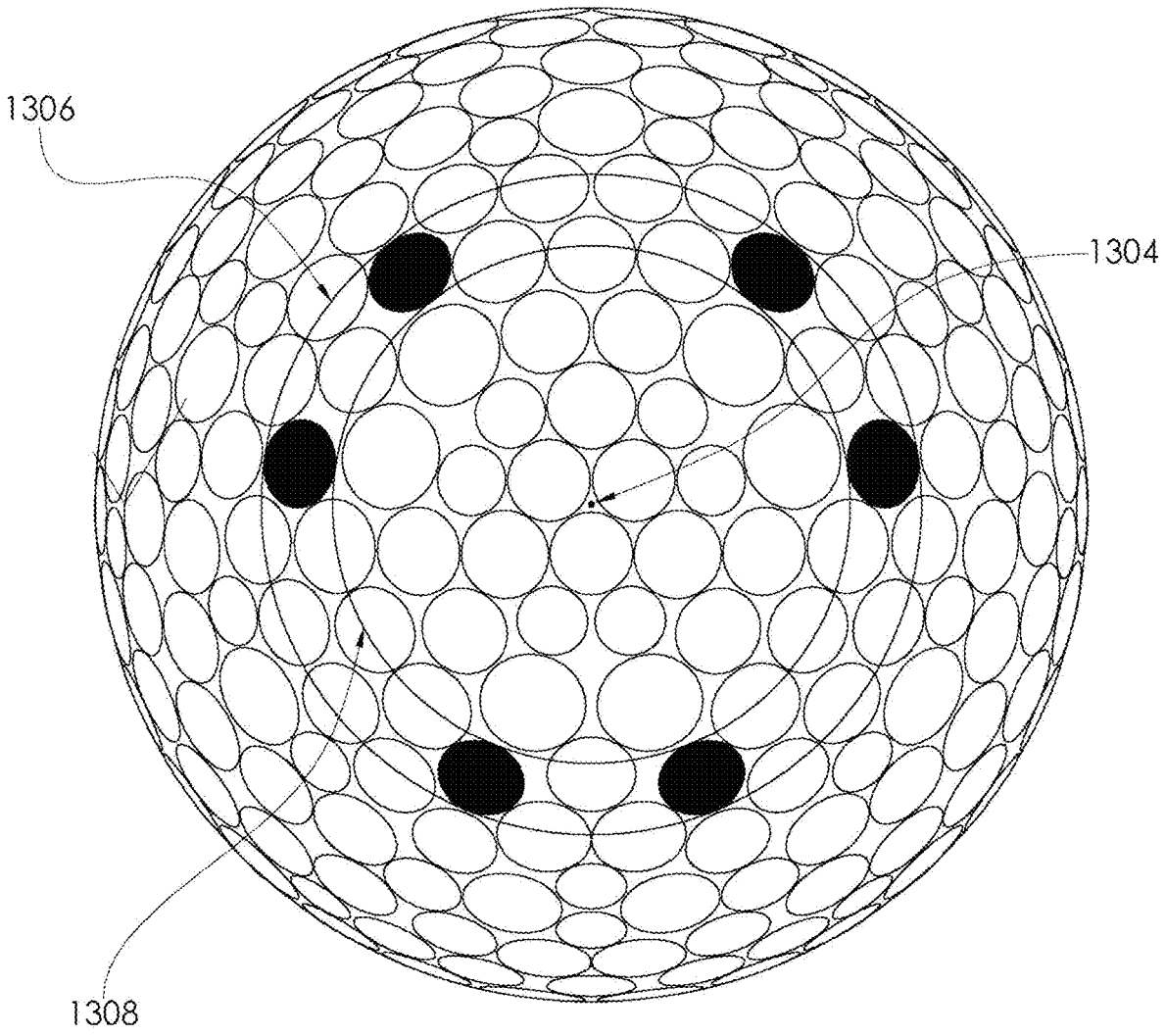
FIG. 15B is a first alternative view of the golf ball illustrated in FIG. 15A.
Figure 15C:
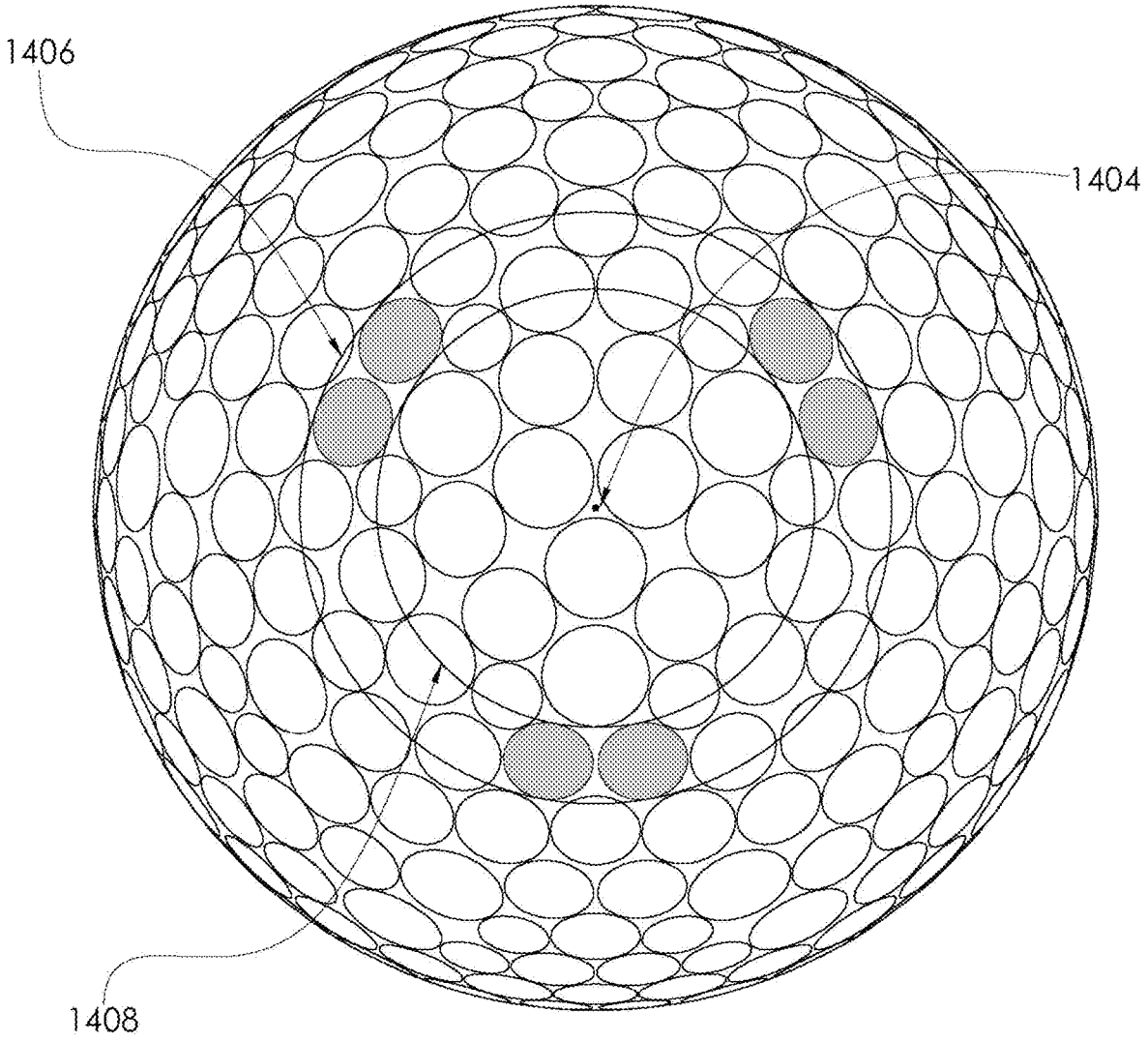
FIG. 15C is a second alternative view of the golf ball illustrated in FIG. 15A.

FIGS. 15A-15C illustrate a seamless golf ball having 396 dimples arranged in a tetrahedron-based pattern, with modified dimples designated by shading. FIG. 15A is a polar view of the golf ball, and shows the dimple pattern of one of the two identical hemispheres divided by reference grid lines into two identical first regions 1300 and two identical second regions 1400. The modified dimples within the first region 1300 include four modified dimples 1302 and two additional modified dimples that are located relatively close to the equator and are not clearly visible in the polar view of FIG. 15A. As shown in FIG. 15B, the six modified dimples within the first region 1300 form a modified dimple group having an axially symmetric pattern about a CAC 1304, which is located on the land area of the golf ball. The modified dimples within the second region 1400 include four modified dimples 1402 and two additional modified dimples that are located relatively close to the equator and are not clearly visible in the polar view of FIG. 15A. As shown in FIG. 15C, the six modified dimples within the second region 1400 form a modified dimple group having an axially symmetric pattern about a CAC 1404, which is located on the land area of the golf ball.

FIG. 15B is a planar view of the golf ball normal to the axis containing the CAC 1304. FIG. 15B shows a reference circle 1306 circumscribing the modified dimple group of first region 1300, and a reference circle 1308 inscribing the modified dimple group of first region 1300.

FIG. 15C is a planar view of the golf ball normal to the axis containing the CAC 1404. FIG. 15C shows a reference circle 1406 circumscribing the modified dimple group of second region 1400, and a reference circle 1408 inscribing the modified dimple group of second region 1400.

In a particular embodiment of the dimple pattern illustrated in FIGS. 15A-15C, the overall dimple pattern consists of circular plan-shaped dimples having at least four different dimple diameters, including a minimum dimple diameter, a maximum dimple diameter, and at least two additional dimple diameters; the modified dimples within first region 1300 are same diameter dimples; the modified dimples within second region 1400 are same diameter dimples; and the modified dimples within first region 1300 have a different diameter than the modified dimples within second region 1400. In a further particular aspect of this particular embodiment, the diameter of the modified dimples within first region 1300 is not the minimum dimple diameter or the maximum dimple diameter, and the diameter of the modified dimples within second region 1400 is not the minimum dimple diameter or the maximum dimple diameter. In an even further particular aspect of this particular embodiment, the minimum dimple diameter is 0.120 inches, the maximum dimple diameter is 0.170 inches, the diameter of the modified dimples within first region 1300 is 0.160 inches, and the diameter of the modified dimples within second region 1400 is 0.150 inches.

In another particular embodiment of the dimple pattern illustrated in FIGS. 15A-15C, all of the dimples are spherical dimples; all of the unmodified dimples have the same edge angle; all of the modified dimples, including the modified dimples within first region 1300 and the modified dimples within second region 1400, have the same edge angle; and the edge angle of the unmodified dimples is not equal to the edge angle of the modified dimples. In a particular aspect of this particular embodiment, the edge angle of the modified dimples is 1° smaller than the edge angle of the unmodified dimples. In a further particular aspect of this particular embodiment, the unmodified dimples have an edge angle of 14°, and the modified dimples have an edge angle of 13°.

In another particular embodiment of the dimple pattern illustrated in FIGS. 15A-15C, all of the dimples are catenary dimples; all of the unmodified dimples have the same shape factor and chord depth; all of the modified dimples, including the modified dimples within first region 1300 and the modified dimples within second region 1400, have the same shape factor and chord depth; and neither the shape factor nor the chord depth of the unmodified dimples is equal to that of the modified dimples. In a particular aspect of this particular embodiment, the shape factor of the modified dimples is at least 10% greater than the shape factor of the unmodified dimples. In a further particular aspect of this particular embodiment, the unmodified dimples have a shape factor of 50, and the modified dimples have a shape factor of 60.

In another particular embodiment of the dimple pattern illustrated in FIGS. 15A-15C, reference circle 1306 circumscribing the modified dimples of first region 1300 has a diameter of greater than 0.850 inches, and reference circle 1406 circumscribing the modified dimples of second region 1400 has a diameter of greater than 0.850 inches. In a particular aspect of this particular embodiment, reference circle 1308 inscribing the modified dimples of first region 1300 has a diameter of greater than 0.750 inches, and reference circle 1408 inscribing the modified dimples of second region 1400 has a diameter of greater than 0.750 inches. In a further particular aspect of this particular embodiment, reference circle 1306 has a diameter of 0.876 inches, reference circle 1308 has a diameter of 0.773 inches, reference circle 1406 has a diameter of 1.117 inches, and reference circle 1408 has a diameter of 0.990 inches.

Modifying dimples according to the present invention preferably produces a golf ball with improved flight symmetry compared to a corresponding golf ball without the modified dimples.

In a particular embodiment, the present invention is directed to a seamless golf ball, wherein the dimples have been modified using the dimple modification method disclosed herein. Seamless golf balls and methods of producing such are further disclosed, for example, in U.S. Pat. Nos. 6,849,007 and 7,422,529, the entire disclosures of which are hereby incorporated herein by reference.

While golf balls of the present invention are not limited to a particular dimple count, in a particular embodiment, the golf ball has a dimple count of 300 or 302 or 312 or 328 or 342 or 344 or 348 or 352 or 364 or 376 or 388. In another particular embodiment, the total number of dimples on the outer surface of the golf ball is an integer that is divisible by 4 and within a range of from 260 to 424.

Figure 16:
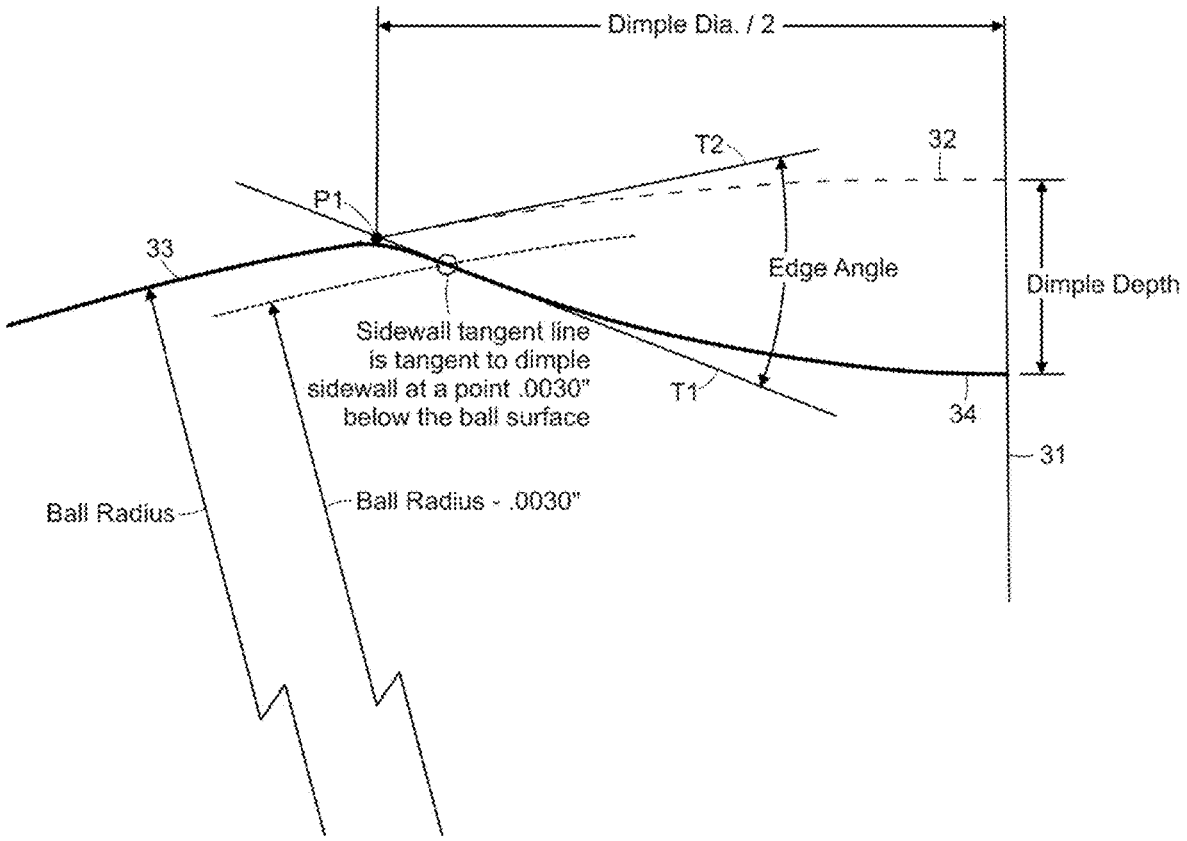
FIG. 16 is a schematic diagram illustrating a method for measuring the diameter of a dimple.

For purposes of the present disclosure, the diameter of a dimple having a circular plan shape is determined on a finished golf ball according to FIG. 16. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, dimple diameter on a finished golf ball is measured according to the method shown in FIG. 16. FIG. 16 shows a dimple half-profile 34, extending from the dimple centerline 31 to the land surface outside of the dimple 33. A ball phantom surface 32 is constructed above the dimple as a continuation of the land surface 33. A first tangent line T1 is then constructed at a point on the dimple sidewall that is spaced 0.003 inches radially inward from the phantom surface 32. T1 intersects phantom surface 32 at a point P1, which defines a nominal dimple edge position. A second tangent line T2 is then constructed, tangent to the phantom surface 32, at P1. The edge angle is the angle between T1 and T2. The dimple diameter is the distance between P1 and its equivalent point diametrically opposite along the dimple perimeter. Alternatively, it is twice the distance between P1 and the dimple centerline 31, measured in a direction perpendicular to centerline 31. The dimple depth is the distance measured along a ball radius from the phantom surface of the ball to the deepest point on the dimple. The dimple volume is the space enclosed between the phantom surface 32 and the dimple surface 34 (extended along T1 until it intersects the phantom surface). The diameter of a dimple having a non-circular plan shape is defined by its equivalent diameter, $d_e$, calculated as:

$$d_e = 2\sqrt{\frac{A}{\pi}}$$

where A is the plan shape area of the dimple.

For purposes of the present disclosure, the phrases "same diameter dimples," "dimples having the same diameter," and "dimples having substantially the same diameter" are used interchangeably and include dimples on a finished ball having respective diameters that differ by less than 0.005 inches due to manufacturing variances.

When numerical lower limits and numerical upper limits are set forth herein, it is contemplated that any combination of these values may be used.

All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a plurality of dimples forming an overall dimple pattern on the outermost surface of the golf ball, wherein:

the golf ball consists of two hemispheres having identical dimple patterns, each hemisphere consisting of two first regions and two second regions;

the two first regions have an identical first dimple pattern and the two second regions have an identical second dimple pattern, the first dimple pattern being different from the second dimple pattern;

each of the first dimple pattern and the second dimple pattern consists of a majority of unmodified spherical dimples having the same edge angle and a plurality of modified spherical dimples, each modified spherical dimple having an edge angle that is from 1° to 4° different than the edge angle of the unmodified spherical dimples;

the plurality of modified spherical dimples of the first dimple pattern form a first axially symmetric pattern about a first geometric center, the plurality of modified spherical dimples of the second dimple pattern form a second axially symmetric pattern about a second geometric center; and a first reference circle circumscribing the plurality of modified spherical dimples of the first dimple pattern has a diameter of greater than 0.850 inches and a second reference circle circumscribing the plurality of spherical modified dimples of the second dimple pattern has a diameter of greater than 0.850 inches.

2. The golf ball of claim 1, wherein the plurality of modified spherical dimples of the first dimple pattern are same diameter dimples.

3. The golf ball of claim 2, wherein the plurality of modified spherical dimples of the second dimple pattern are same diameter dimples, and wherein the diameter of the modified spherical dimples of the first dimple pattern is different from the diameter of the modified spherical dimples of the second dimple pattern.

4. The golf ball of claim 1, wherein the number of modified spherical dimples of the first dimple pattern is equal to the number of modified spherical dimples of the second dimple pattern.

5. The golf ball of claim 1, wherein the overall dimple pattern includes at least three different dimple diameters, including a minimum dimple diameter, a maximum dimple diameter, and at least one additional dimple diameter, and wherein none of the modified spherical dimples on the ball has a diameter that is the maximum dimple diameter or the minimum dimple diameter.

6. The golf ball of claim 1, wherein none of the modified spherical dimples of the first dimple pattern is nearest neighbors with any modified spherical dimples of the second dimple pattern.

7. The golf ball of claim 1, wherein no modified spherical dimple of the first dimple pattern is nearest neighbors with another modified spherical dimple of the first dimple pattern, and wherein each modified spherical dimple of the second dimple pattern is nearest neighbors with another modified spherical dimple of the second dimple pattern.

8. A golf ball comprising a plurality of dimples forming an overall dimple pattern on the outermost surface of the golf ball, wherein:

the golf ball consists of two hemispheres having identical dimple patterns, each hemisphere consisting of two first regions and two second regions;

the two first regions have an identical first dimple pattern and the two second regions have an identical second dimple pattern, the first dimple pattern being different from the second dimple pattern;

each of the first dimple pattern and the second dimple pattern consists of a majority of unmodified catenary dimples having the same shape factor and a plurality of modified catenary dimples, each modified catenary dimple having a shape factor that is at least 10% greater than or less than the shape factor of the unmodified dimples;

the plurality of modified catenary dimples of the first dimple pattern form a first axially symmetric pattern about a first geometric center, the plurality of modified catenary dimples of the second dimple pattern form a second axially symmetric pattern about a second geometric center; and a first reference circle circumscribing the plurality of modified catenary dimples of the first dimple pattern has a diameter of greater than 0.850 inches and a second reference circle circumscribing the plurality of modified catenary dimples of the second dimple pattern has a diameter of greater than 0.850 inches.

9. The golf ball of claim 8, wherein each of the plurality of modified catenary dimples of the first dimple pattern has the same shape factor.

10. The golf ball of claim 9, wherein each of the plurality of modified catenary dimples of the second dimple pattern has the same shape factor, and wherein the shape factor of the modified catenary dimples of the first dimple pattern is different than the shape factor of the modified catenary dimples of the second dimple pattern.

11. The golf ball of claim 8, wherein each of the plurality of modified catenary dimples on the ball has the same shape factor.

12. The golf ball of claim 8, wherein the number of modified catenary dimples of the first dimple pattern is equal to the number of modified catenary dimples of the second dimple pattern.

13. The golf ball of claim 8, wherein none of the modified catenary dimples of the first dimple pattern is nearest neighbors with any modified catenary dimples of the second dimple pattern.

14. The golf ball of claim 8, wherein no modified catenary dimple of the first dimple pattern is nearest neighbors with another modified catenary dimple of the first dimple pattern, and wherein each modified catenary dimple of the second dimple pattern is nearest neighbors with another modified catenary dimple of the second dimple pattern.

15. A golf ball comprising a plurality of dimples forming an overall dimple pattern on the outermost surface of the golf ball, wherein:

the golf ball consists of two hemispheres having identical dimple patterns, each hemisphere consisting of two first regions and two second regions;

the two first regions have an identical first dimple pattern and the two second regions have an identical second dimple pattern, the first dimple pattern being different from the second dimple pattern;

each of the first dimple pattern and the second dimple pattern consists of a majority of unmodified catenary dimples having the same shape factor and a plurality of modified catenary dimples, each modified catenary dimple having a chord depth that is at least 0.0002 inches greater than or less than the shape factor of the unmodified dimples;

the plurality of modified dimples of the first dimple pattern form a first axially symmetric pattern about a first geometric center, the plurality of modified dimples of the second dimple pattern form a second axially symmetric pattern about a second geometric center; and a first reference circle circumscribing the plurality of modified dimples of the first dimple pattern has a diameter of greater than 0.850 inches and a second reference circle circumscribing the plurality of modified dimples of the second dimple pattern has a diameter of greater than 0.850 inches.

16. The golf ball of claim 15, wherein each of the plurality of modified catenary dimples of the first dimple pattern has the same chord depth.

17. The golf ball of claim 16, wherein each of the plurality of modified catenary dimples of the second dimple pattern has the same chord depth, and wherein the chord depth of the modified catenary dimples of the first dimple pattern is different than the chord depth of the modified catenary dimples of the second dimple pattern.

18. The golf ball of claim 15, wherein each of the plurality of modified catenary dimples on the ball has the same chord depth.

19. The golf ball of claim 15, wherein the number of modified catenary dimples of the first dimple pattern is equal to the number of modified catenary dimples of the second dimple pattern.

20. The golf ball of claim 15, wherein none of the modified catenary dimples of the first dimple pattern is nearest neighbors with any modified catenary dimples of the second dimple pattern.

21. The golf ball of claim 15, wherein no modified catenary dimple of the first dimple pattern is nearest neighbors with another modified catenary dimple of the first dimple pattern, and wherein each modified catenary dimple of the second dimple pattern is nearest neighbors with another modified catenary dimple of the second dimple pattern.

* * * * *